US011313382B2

(12) United States Patent
Sawada et al.

(10) Patent No.: US 11,313,382 B2
(45) Date of Patent: Apr. 26, 2022

(54) PROPELLER FAN

(71) Applicant: FUJITSU GENERAL LIMITED, Kanagawa (JP)

(72) Inventors: Hirotaka Sawada, Kanagawa (JP); Kazuya Funada, Kanagawa (JP)

(73) Assignee: FUJITSU GENERAL LIMITED, Kanagawa (JP)

( * ) Notice: Subject to any disclaimer, the term of this patent is extended or adjusted under 35 U.S.C. 154(b) by 0 days.

(21) Appl. No.: 17/294,554

(22) PCT Filed: Nov. 22, 2019

(86) PCT No.: PCT/JP2019/045880

§ 371 (c)(1),
(2) Date: May 17, 2021

(87) PCT Pub. No.: WO2020/110969

PCT Pub. Date: Jun. 4, 2020

(65) Prior Publication Data

US 2022/0018358 A1 Jan. 20, 2022

(30) Foreign Application Priority Data

Nov. 30, 2018 (JP) ..... JP2018-226038

(51) Int. Cl.

| | |
|---|---|
| ***F04D 29/38*** | (2006.01) |
| ***F04D 29/24*** | (2006.01) |
| ***F04D 19/00*** | (2006.01) |
| ***F04D 29/18*** | (2006.01) |
| ***F04D 29/22*** | (2006.01) |

(Continued)

(52) U.S. Cl.

CPC ..... *F04D 29/384* (2013.01); *F04D 19/002* (2013.01); *F04D 29/181* (2013.01); *F04D 29/2216* (2013.01); *F04D 29/242* (2013.01); *F04D 29/34* (2013.01); *F04D 29/38* (2013.01); *F04D 29/388* (2013.01); *F04D 29/329* (2013.01); *F05D 2240/305* (2013.01)

(58) Field of Classification Search

CPC .... F04D 29/384; F04D 19/002; F04D 29/181; F04D 29/2216; F04D 29/242; F04D 29/34; F04D 29/38; F04D 29/388; F04D 29/329; F05D 2240/305

USPC ..... 416/228

See application file for complete search history.

(56) References Cited

U.S. PATENT DOCUMENTS

| | | | |
|---|---|---|---|
| 6,736,600 | B1 | 5/2004 | Bannasch |
| 8,535,010 | B2 | 9/2013 | Terao |

(Continued)

FOREIGN PATENT DOCUMENTS

| | | | |
|---|---|---|---|
| CN | 104047893 | A | 9/2014 |
| JP | 2003-503643 | A | 1/2003 |

(Continued)

*Primary Examiner* — Yi-Kai Wang

(74) *Attorney, Agent, or Firm* — Paratus Law Group, PLLC

(57) ABSTRACT

On the blade surface part, a first opening passing through the blade surface part from a negative pressure side toward a positive pressure side is provided between the first blade element and the second blade element. A chord length of the first blade element along a direction connecting the apex A with the point B, is equal to or larger than a chord length of the second blade element along a direction connecting an apex C with a point D.

7 Claims, 22 Drawing Sheets

(51) Int. Cl.
*F04D 29/34* (2006.01)
*F04D 29/32* (2006.01)

(56) References Cited

U.S. PATENT DOCUMENTS

| | | | | |
|---|---|---|---|---|
| 2018/0003190 | A1* | 1/2018 | Hamada | F04D 29/38 |
| 2018/0335045 | A1* | 11/2018 | Sawada | F04D 29/38 |

FOREIGN PATENT DOCUMENTS

| | | | |
|---|---|---|---|
| JP | 2004-116511 | A | 4/2004 |
| JP | 2010-101223 | A | 5/2010 |
| WO | WO 2011/001890 | A1 | 1/2011 |

* cited by examiner

PROPELLER FAN

CROSS REFERENCE TO PRIOR APPLICATION

This application is a National Stage Patent Application of PCT International Patent Application No. PCT/JP2019/045880 (filed on Nov. 22, 2019) under 35 U.S.C. § 371, which claims priority to Japanese Patent Application No. 2018-226038 (filed on Nov. 30, 2018), which are all hereby incorporated by reference in their entirety.

FIELD

The present invention relates to a propeller fan.

BACKGROUND

Outdoor units of air conditioners include a propeller fan inside. In recent years, an air volume of the propeller fan has been increased to improve energy saving performance of air conditioners. In the propeller fan, a wind speed tends to be high at an outer peripheral part of a blade, and the wind speed tends to be lowered at a part closer to an inner peripheral part as a rotation center of the blade. Patent Literatures 1 to 4 have been proposed to compensate for reduction in the wind speed at the inner peripheral part of the blade, and the diameter of the propeller fan and a rotation speed thereof have been increased to increase the air volume by increasing the wind speed of the propeller fan.

CITATION LIST

Patent Literature

Patent Literature 1: Japanese Patent Application Laid-open No. 2010-101223
Patent Literature 2: WO 2011/001890
Patent Literature 3: Japanese Patent Application Laid-open No. 2003-503643
Patent Literature 4: Japanese Patent Application Laid-open No. 2004-116511

SUMMARY

Technical Problem

However, as described in Patent Literatures 1 to 4, in a case in which the diameter and the rotation speed of the propeller fan are increased, a wind speed difference between the outer peripheral part and the inner peripheral part of the blade is further increased, and a problem is caused by the wind speed difference. When the wind speed at the outer peripheral part of the blade is increased as a result of increasing the diameter and the rotation speed of the propeller fan to compensate for deficiency of the wind speed (air volume) at the inner peripheral part of the blade, an air current generated by the blade may interfere with a structure of the outdoor unit around the blade to cause a strange sound. The wind speed at the inner peripheral part is lower than that at the outer peripheral part of the blade, so that wind generated at the inner peripheral part flows to the outer peripheral part by centrifugal force to disturb flow of wind generated at the outer peripheral part. When the air current at the outer peripheral part of the blade is disturbed by the air current at the inner peripheral part, the volume of air sent from the outer peripheral part is reduced.

The technique disclosed herein has been developed in view of such a situation, and provides a propeller fan capable of increasing the wind speed at the inner peripheral part of the blade.

Solution to Problem

According to an aspect of the embodiments, a propeller fan includes: a hub including a side surface around a center axis; and a plurality of blades disposed on the side surface of the hub, wherein the blades each include a blade surface part, which is extended from a base end connected to the side surface of the hub to an outer edge, and the blade surface part includes an inner peripheral part, which is positioned on the base end side, and an outer peripheral part which is positioned on the outer edge side, an inner peripheral blade, which extends from the side surface of the hub toward the outer edge side, is formed on a positive pressure surface of the blade surface part at the inner peripheral part of each of the blades, the inner peripheral blade includes a plurality of blade elements that project from the positive pressure surface of the blade surface part toward a positive pressure side, and are arranged side by side in a rotation direction of the blade, the blade elements include a first blade element, which is arranged on a front edge side in the rotation direction of the blade, and a second blade element, which is arranged to be adjacent to the first blade element on a rear edge side in the rotation direction of the blade, a first opening, which passes through the blade surface part from a negative pressure side toward the positive pressure side, is provided between the first blade element and the second blade element on the blade surface part, when an apex projecting from the positive pressure surface of the first blade element is A, a distance from the center axis to the apex A is r1, and a point having the distance r1 from the center axis on a front edge in a rotation direction of the first blade element is B, a chord length of the first blade element along a direction connecting the apex A with the point B, is equal to or larger than a chord length of the second blade element along a direction connecting an apex C with a point D when an apex projecting from the positive pressure surface of the second blade element is C, a distance from the center axis to the apex C is r2, and a point having the distance r2 from the center axis on a front edge in a rotation direction of the second blade element is D.

Advantageous Effects of Invention

According to an aspect of the propeller fan disclosed herein, the wind speed at the inner peripheral part of the blade can be increased.

DESCRIPTION OF EMBODIMENTS

The following describes embodiments of a propeller fan disclosed herein in detail based on the drawings. The propeller fan disclosed herein is not restricted to the embodiments described below.

First Embodiment

Configuration of Outdoor Unit

Figure 1:
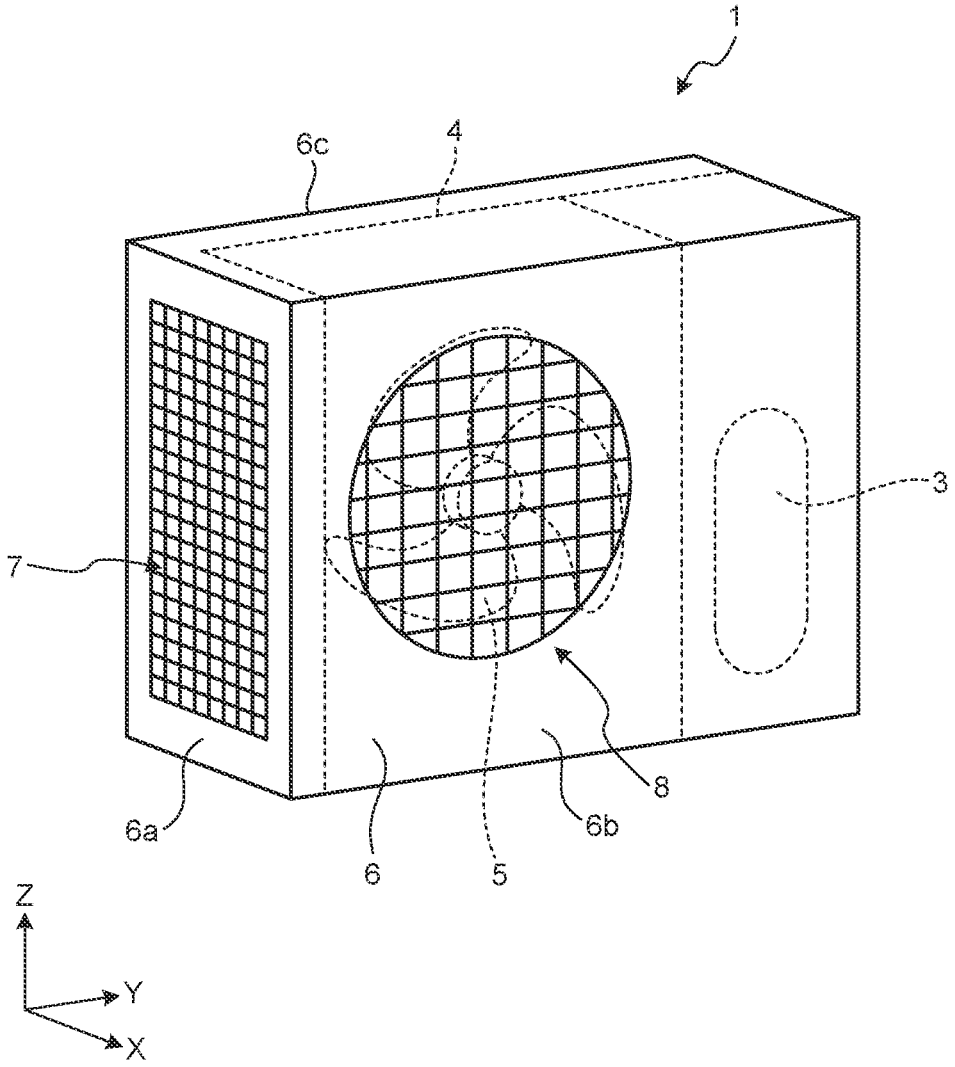
FIG. 1 is a perspective view of external appearance of an outdoor unit including a propeller fan according to a first embodiment.

FIG. 1 is a perspective view of external appearance of an outdoor unit including a propeller fan according to a first embodiment. In FIG. 1, a front and rear direction of an outdoor unit 1 is assumed to be the X-direction, a right and left direction of the outdoor unit 1 is assumed to be the Y-direction, and an upper and lower direction of the outdoor unit 1 is assumed to be the Z-direction. As illustrated in FIG. 1, the outdoor unit 1 according to the first embodiment constitutes part of an air conditioner, and includes a compressor 3 that compresses a refrigerant, a heat exchanger 4 that exchanges heat between outside air and the refrigerant flowing thereinto due to driving of the compressor 3, a propeller fan 5 for sending outside air to the heat exchanger 4, and a housing 6 that houses the compressor 3, the heat exchanger 4, and the propeller fan 5.

The housing 6 of the outdoor unit 1 includes a suction port 7 for taking in outside air, and a blowoff port 8 for discharging the outside air that has been heat-exchanged with the refrigerant in the heat exchanger 4 from the inside of the housing 6 to the outside. The suction port 7 is disposed on a side surface 6*a* of the housing 6 and a back surface 6*c* that is opposed to a front surface 6*b* of the housing 6. The blowoff port 8 is disposed on the front surface 6*b* of the housing 6. The heat exchanger 4 is arranged across the back surface 6*c* to the side surface 6*a*. The propeller fan 5 is arranged to be opposed to the blowoff port 8, and rotated by a fan motor (not illustrated). In the outdoor unit 1, when the propeller fan 5 is rotated, outside air, which is sucked through the suction port 7, passes through the heat exchanger 4, and the air, which is passed through the heat exchanger 4, is discharged through the blowoff port 8. In this way, the outside air is heat-exchanged with the refrigerant in the heat exchanger 4 when the outside air passes through the heat exchanger 4, so that the refrigerant, which flows through the heat exchanger 4, is cooled in a cooling operation, or heated in a heating operation. A use of the propeller fan 5 according to the first embodiment is not restricted to a use for the outdoor unit 1.

In the following description, in the propeller fan 5, a positive pressure side P is assumed to be a side toward which air flows from the propeller fan 5 to the blowoff port 8 when the propeller fan 5 rotates, and a negative pressure side N is assumed to be an opposite side thereof toward which air flows from the heat exchanger 4 to the propeller fan 5.

Configuration of Propeller Fan

Figure 2:
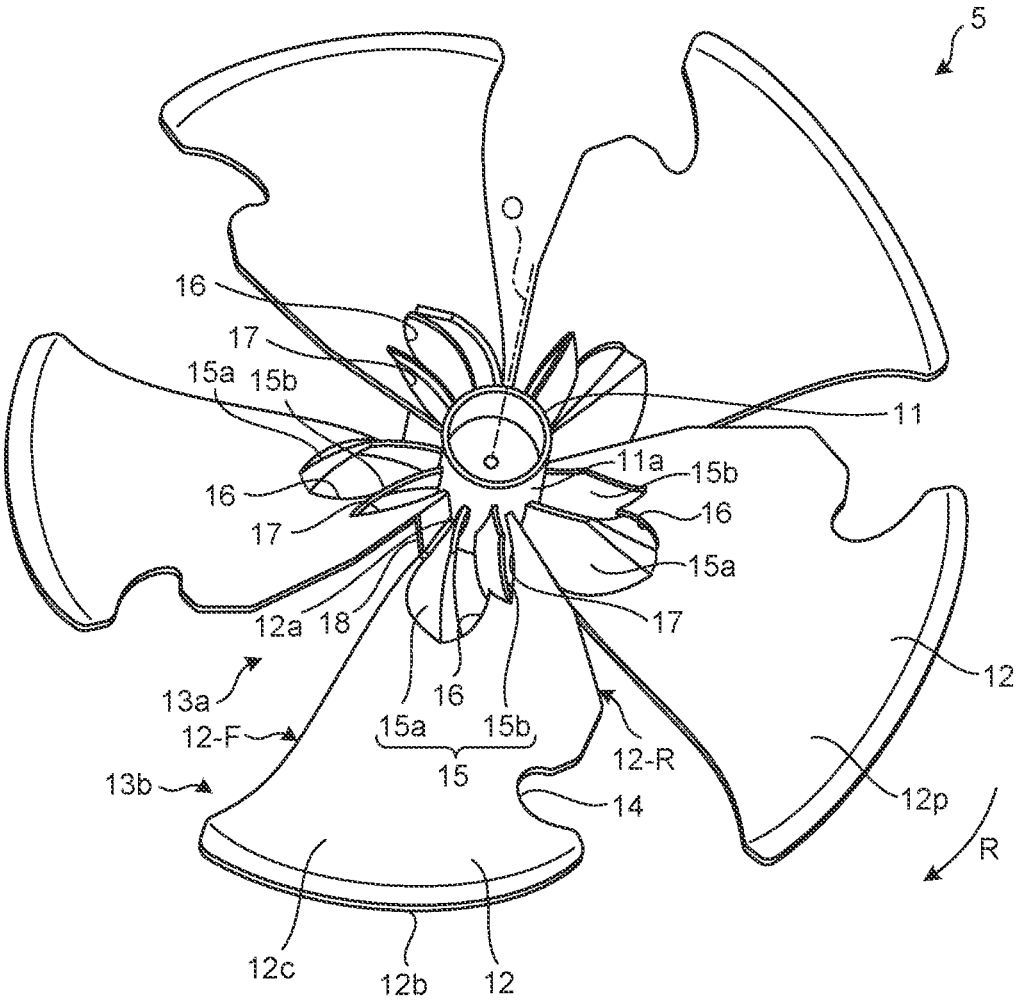
FIG. 2 is a perspective view of the propeller fan according to the first embodiment, viewed from a positive pressure side.
Figure 3:
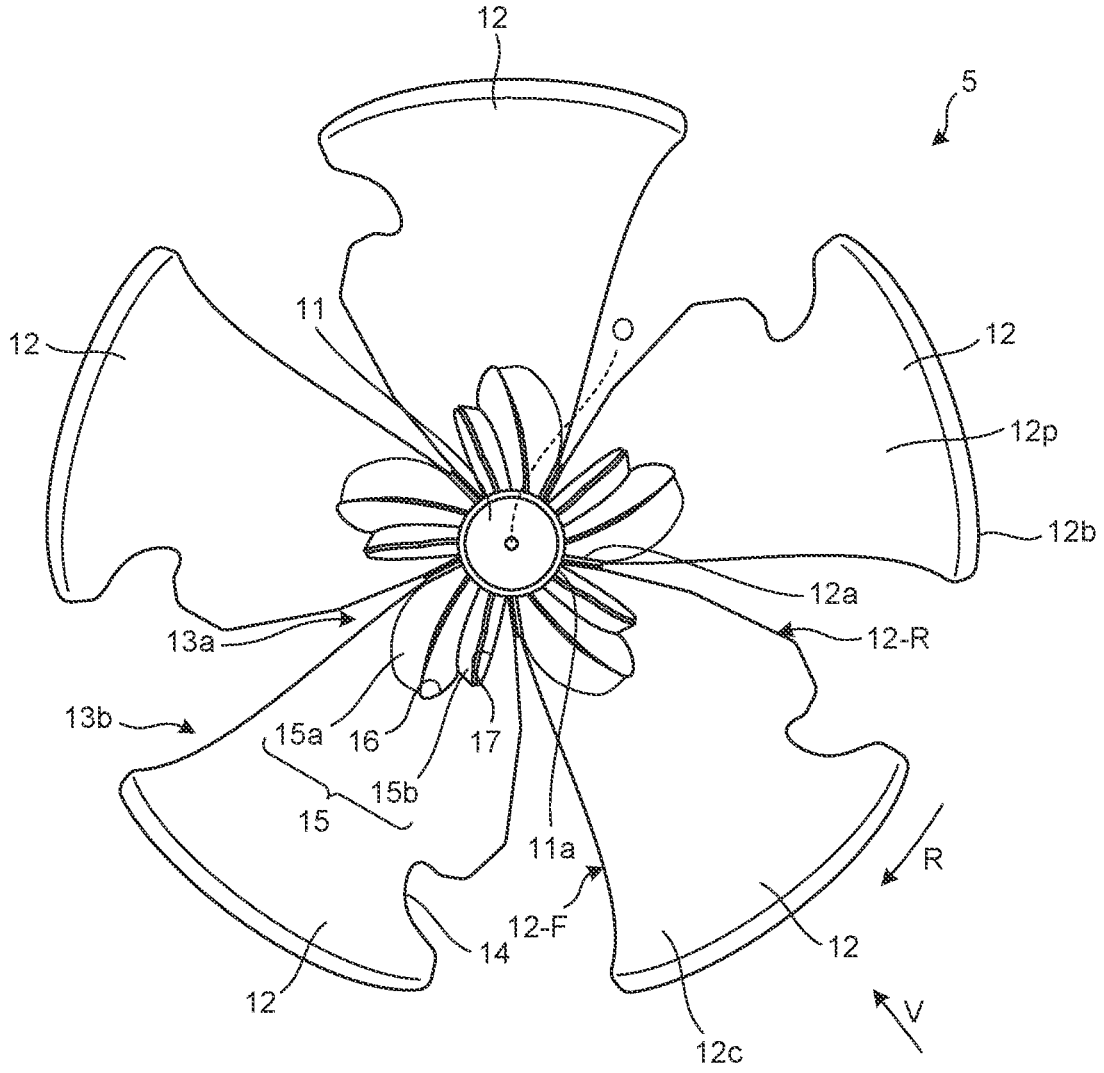
FIG. 3 is a plan view of the propeller fan according to the first embodiment, viewed from the positive pressure side.
Figure 4:
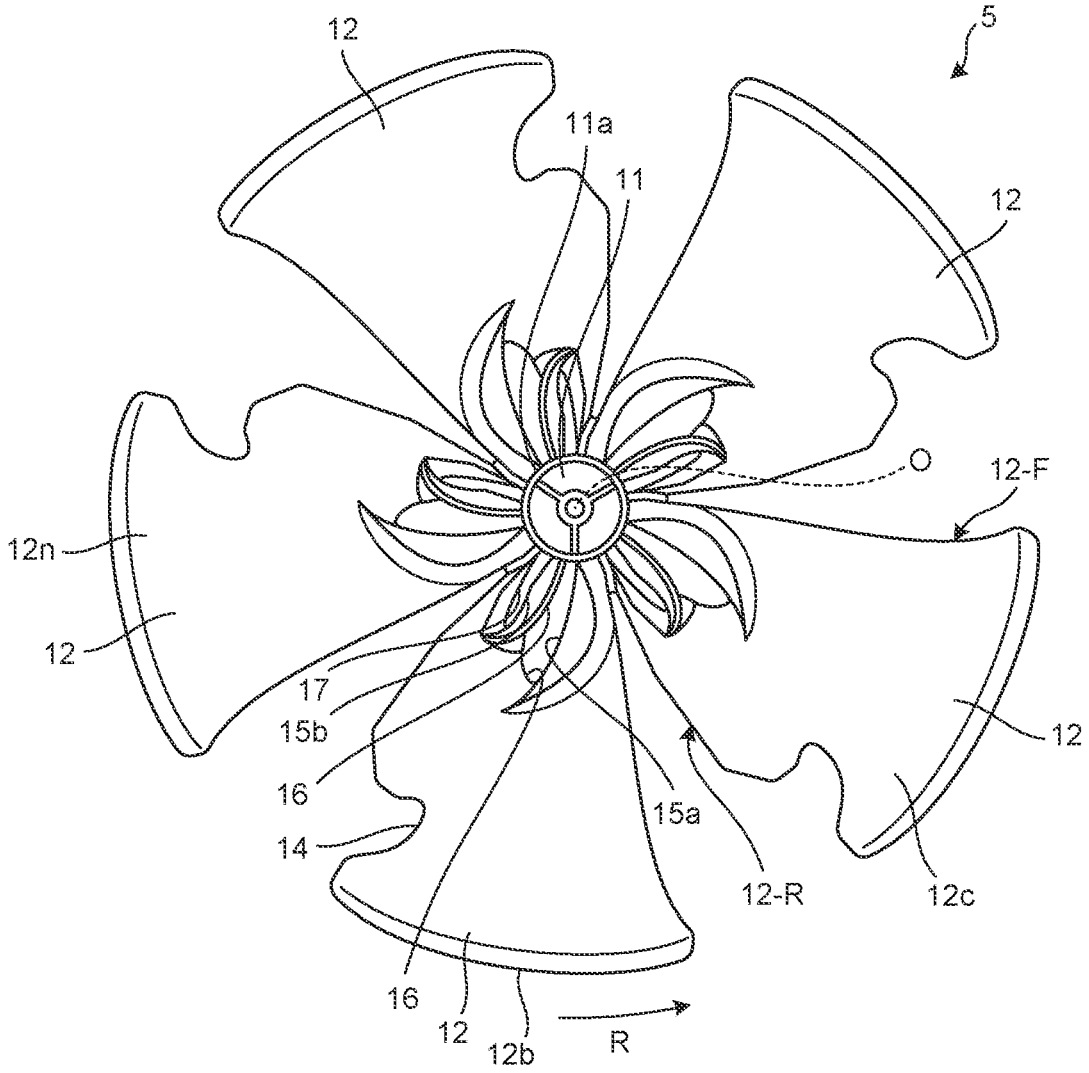
FIG. 4 is a plan view of the propeller fan according to the first embodiment, viewed from a negative pressure side.
Figure 5:
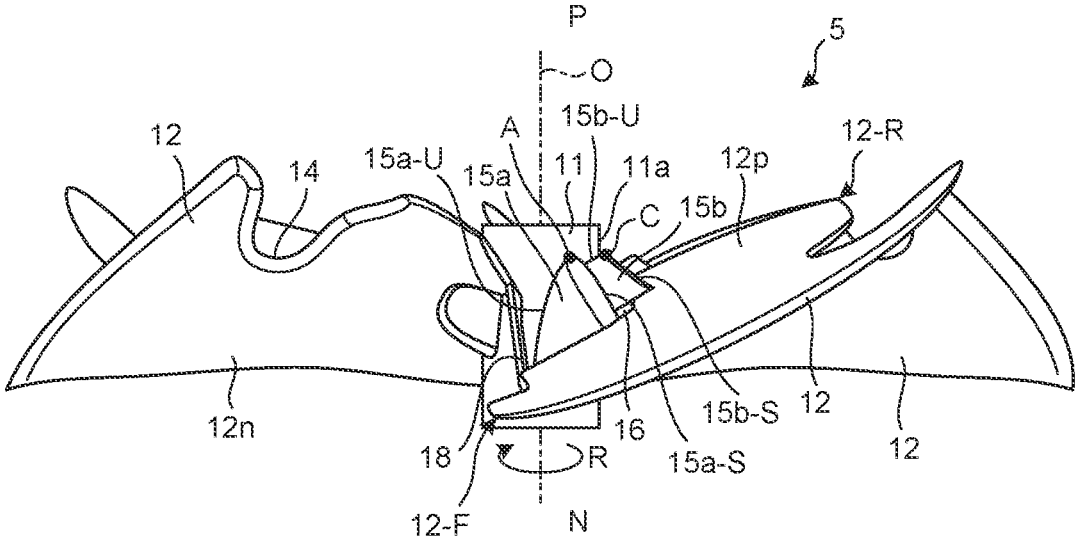
FIG. 5 is a side view of the propeller fan according to the first embodiment.

FIG. 2 is a perspective view of the propeller fan 5 according to the first embodiment, viewed from the positive pressure side P. FIG. 3 is a plan view of the propeller fan 5 according to the first embodiment, viewed from the positive pressure side P. FIG. 4 is a plan view of the propeller fan 5 according to the first embodiment, viewed from the negative pressure side N. FIG. 5 is a side view of the propeller fan 5 according to the first embodiment. FIG. 5 is a side view viewed from the V-direction in FIG. 3.

As illustrated in FIG. 2, FIG. 3, and FIG. 4, the propeller fan 5 includes a hub 11 as a rotation center part, and a plurality of blades 12 that are disposed on the hub 11. The hub 11 includes a side surface 11*a* around a center axis O, and is formed in a cylindrical shape, for example. A boss to which a shaft of a fan motor (not illustrated) is fixed, is disposed on the hub 11 at a position of the center axis O of the hub 11 at an end part on the negative pressure side N of the propeller fan 5. The hub 11 rotates in the R-direction (clockwise direction in FIG. 2) about the center axis O of the hub 11 as the fan motor rotates. The shape of the hub 11 is not restricted to the cylindrical shape, and may be a polygonal cylindrical shape having a plurality of the side surfaces 11*a*.

The blade 12 is a fan of the propeller fan 5. As illustrated in FIG. 2, FIG. 3, and FIG. 5, the blades 12 (five blades 12 in the first embodiment) are integrally formed at predetermined intervals around the center axis O on the side surface 11*a* of the hub 11. The blades 12 are extended from the center axis O of the hub 11 in a radial direction on the side surface 11*a* of the hub 11. The blades 12 each include a blade surface part 12*c* that is extended from a base end 12*a*, which is connected to the side surface 11*a* of the hub 11, to an outer edge 12*b*. Each of the blades 12 includes an inner peripheral part 13*a* that is positioned on the base end 12*a* side, and an outer peripheral part 13*b* that is positioned on the outer edge 12*b* side in the blade surface part 12*c*. The blade surface part 12*c* is formed such that a length thereof along a rotation direction R of the propeller fan 5 is gradually increased from the base end 12*a* side toward the outer edge 12*b* side. In the blade 12 of the propeller fan 5, a blade surface, which faces the positive pressure side P, is assumed to be a positive pressure surface 12*p*, and a blade surface, which faces the negative pressure side N, is assumed to be a negative pressure surface 12*n* (refer to FIG. 5). The hub 11 and the blades 12 are made of resin material or metallic material, for example.

As illustrated in FIG. 2, FIG. 3, and FIG. 4, the blade 12 includes a front edge 12-F on a front side in the rotation direction R of the propeller fan 5, and a rear edge 12-R on a rear side in the rotation direction R of the blade 12. The outer peripheral part 13*b* side of the front edge 12-F of the blade 12 is formed in a curved shape to be dented toward the rear edge 12-R side. In a direction along the center axis O of the hub 11, the rear edge 12-R is positioned on the positive pressure side P with respect to the front edge 12-F of the blade 12, and the blade surface part 12*c* of the blade 12 is inclined with respect to the center axis O.

On the rear edge 12-R of the blade 12, a notch part 14 is disposed to divide the rear edge 12-R into the inner peripheral part 13*a* side and the outer peripheral part 13*b* side. The notch part 14 is formed to extend from the rear edge 12-R of the blade 12 toward the front edge 12-F side, and formed in a substantially U-shape tapering toward the front edge 12-F side when viewed from the direction along the center axis O.

Shape of Inner Peripheral Blade

Figure 6:
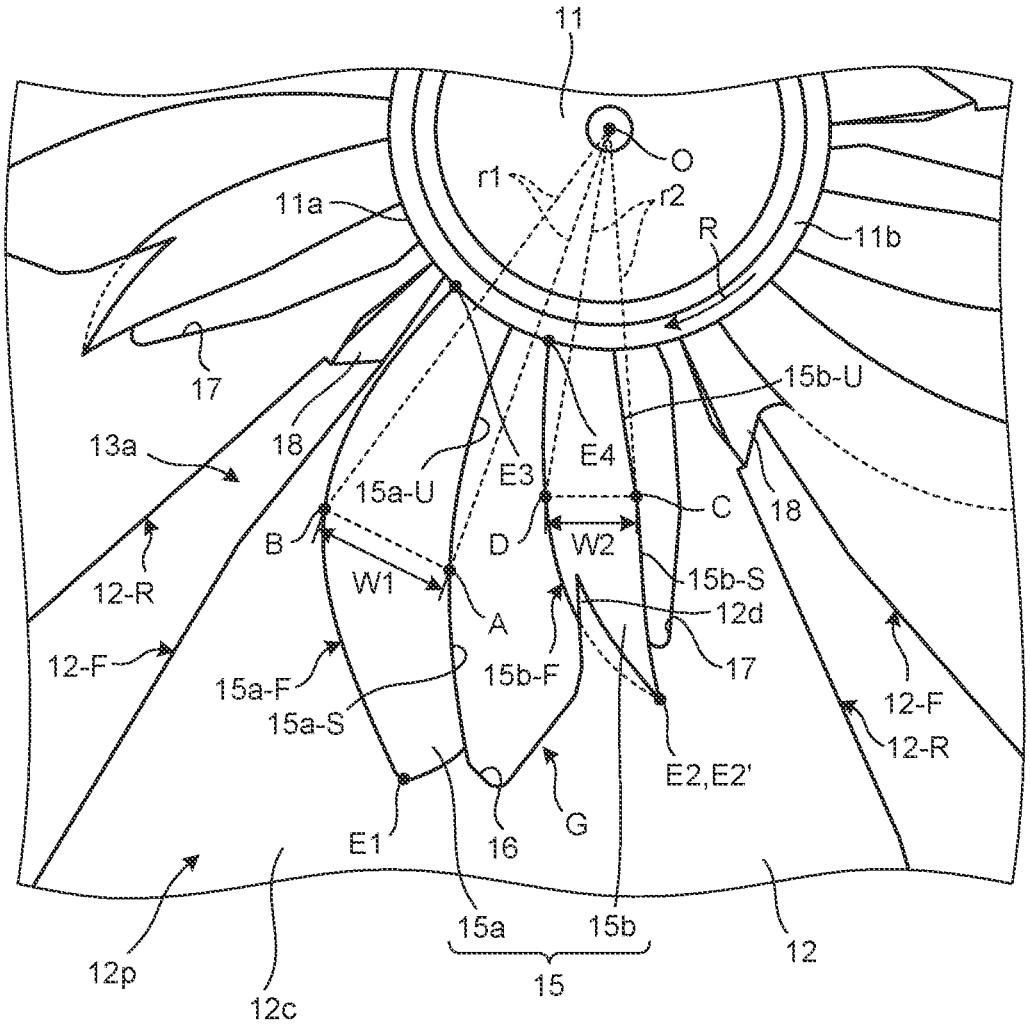
FIG. 6 is an enlarged view of a principal part of an inner peripheral blade of the propeller fan according to the first embodiment viewed, from the positive pressure side.

FIG. 6 is an enlarged view of a principal part of the inner peripheral blade of the propeller fan 5 according to the first embodiment, viewed from the positive pressure side P. As illustrated in FIG. 6, at the inner peripheral part 13*a* of each of the blades 12, an inner peripheral blade 15 extending from the side surface 11*a* of the hub 11 toward the outer edge 12*b* side is formed on the positive pressure surface 12*p* of the blade surface part 12*c*. The inner peripheral blade 15 includes a first blade element 15*a* and a second blade element 15*b* that project from the positive pressure surface 12*p* of the blade surface part 12*c* toward the positive pressure side P, and are arranged side by side along the rotation direction R of the blade 12.

The first blade element 15*a* is arranged on the front edge 12-F side of the blade 12, and coupled to the side surface 11*a* of the hub 11 and the blade surface part 12*c*. The second blade element 15*b* is arranged to be adjacent to the first blade element 15*a* on the rear edge 12-R side of the blade 12, and connected to the side surface 11*a* of the hub 11 and the blade surface part 12*c*. The blade surface part 12*c* includes the first blade element 15*a* and the second blade element 15*b*, so that a wind speed is increased by the first blade element 15*a* and the second blade element 15*b* at the inner peripheral part 13*a* of the blade 12.

Figure 7:
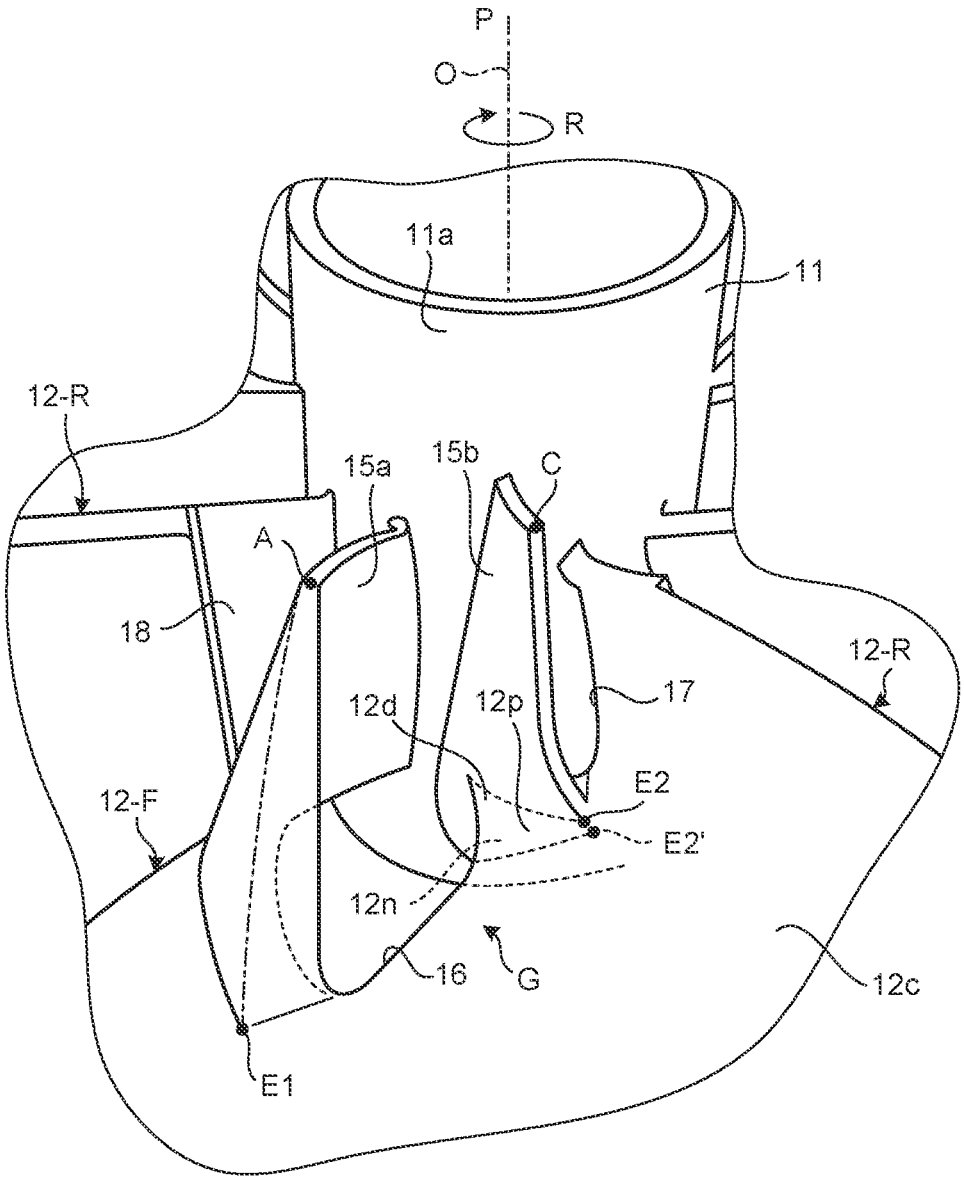
FIG. 7 is an enlarged perspective view of a principal part of a first opening of the propeller fan according to the first embodiment, viewed from the positive pressure side.
Figure 8:
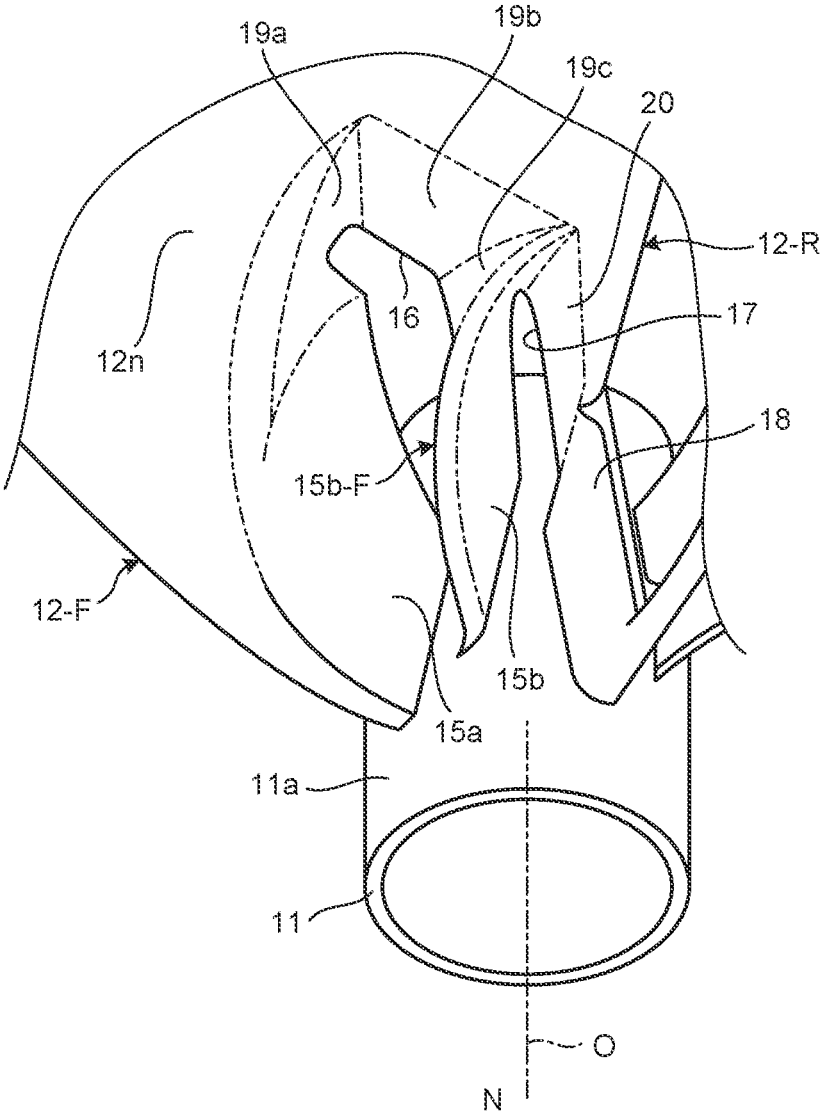
FIG. 8 is an enlarged perspective view of a principal part of the first opening of the propeller fan according to the first embodiment, viewed from the negative pressure side.

FIG. 7 is an enlarged perspective view of a principal part of a first opening 16 of the propeller fan 5 according to the first embodiment, viewed from the positive pressure side P. FIG. 8 is an enlarged perspective view of a principal part of the first opening 16 of the propeller fan 5 according to the first embodiment, viewed from the negative pressure side N. As illustrated in FIG. 7, the first opening 16, which passes through the blade surface part 12*c* from the negative pressure side N toward the positive pressure side P, is provided between the first blade element 15*a* and the second blade element 15*b* on the blade surface part 12*c*. That is, the first opening 16 is a through hole that passes through the blade surface part 12*c*. The first opening 16 is extended to the vicinity of an outer edge E1 of the first blade element 15*a* that is extended from the side surface 11*a* of the hub 11 toward the outer edge 12*b* side of the blade 12. As illustrated in FIG. 6, when viewed from the direction along the center axis O, the first opening 16 opens to be continuous to each of the blade surface of the first blade element 15*a* and the blade surface of the second blade element 15*b* opposed to each other. As illustrated in FIG. 8, the negative pressure surface 12*n* of the blade 12 includes inclined surfaces 19*a*, 19*b*, and 19*c* that are smoothly continuous to an opening edge of the first opening 16 on the positive pressure surface 12*p*.

As illustrated in FIG. 6, on the positive pressure surface 12*p* side of the blade surface part 12*c*, a space between the outer edge E1 of the first blade element 15*a* extended from the side surface 11*a* of the hub 11 toward the outer edge 12*b* side of the blade 12, and an outer edge E2 of the second blade element 15*b* extended from the side surface 11*a* of the hub 11 toward the outer edge 12*b* side of the blade 12, is opened from the side surface 11*a* of the hub 11 in the radial direction of the blade surface part 12*c*, so that an air current, which comes from the negative pressure side N of the blade surface part 12*c* toward the positive pressure side P through the first opening 16, flows from the first opening 16 toward the outer edge 12*b* side of the blade 12 along the positive pressure surface 12*p* of the blade surface part 12*c* (from the side surface 11*a* toward the outer edge 12*b* side of the blade surface part 12*c*). In other words, as illustrated in FIG. 7, a space G continuous to the first opening 16 is secured between the outer edge E1 of the first blade element 15*a* and the outer edge E2 of the second blade element 15*b*, and the first blade element 15*a* and the second blade element 15*b* are formed so that a portion, which interferes with the air current that comes from the first opening 16 toward the outer edge 12*b* side of the blade 12, is not present on the positive pressure surface 12*p* between the outer edge E1 and the outer edge E2.

Figure 9:
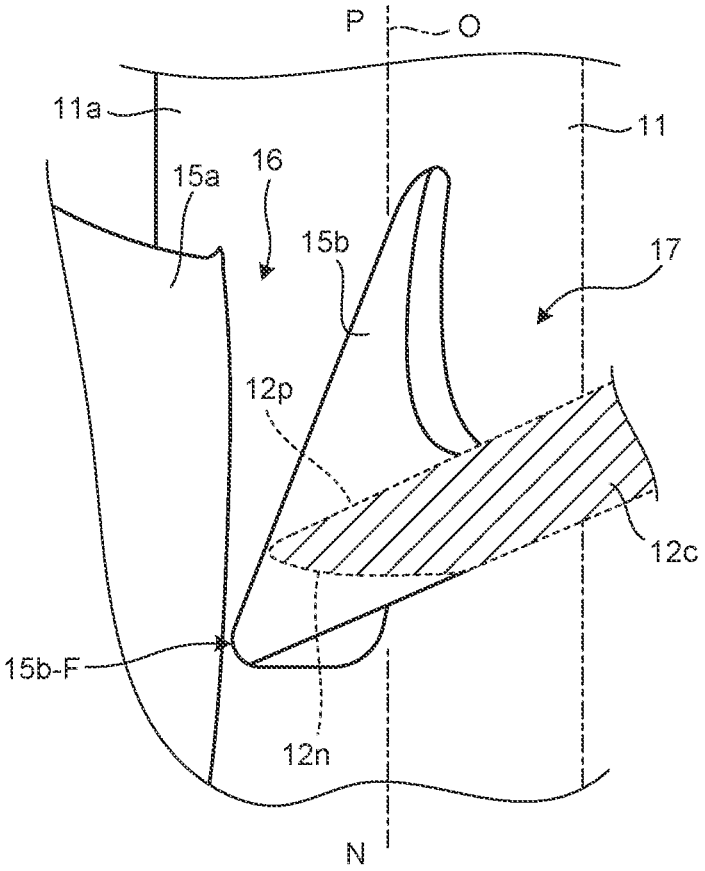
FIG. 9 is for explaining a second blade element of the propeller fan according to the first embodiment.

FIG. 9 is an enlarged side view of a principal part for explaining the second blade element 15*b* of the propeller fan 5 according to the first embodiment. FIG. 9 illustrates a positional relation between the second blade element 15*b* and the blade surface part 12*c*. As illustrated in FIG. 9, the second blade element 15*b* is formed across the positive pressure surface 12*p* and the negative pressure surface 12*n* of the blade surface part 12*c* via the first opening 16. Due to this, the positive pressure surface 12*p* and the negative pressure surface 12*n* of the blade surface part 12*c* are connected to each other on the blade surface on a front edge 15*b*-F side of the second blade element 15*b*. Thus, the front edge 15*b*-F of the second blade element 15*b* in the rotation direction R of the second blade element 15*b* projects from the negative pressure surface 12*n* toward the negative pressure side N in the direction along the center axis O, and is positioned on the negative pressure side N with respect to the negative pressure surface 12*n*. A portion on the front edge 15*b*-F side of the second blade element 15*b* is formed to have a thickness that is gradually reduced toward the front edge 15*b*-F.

The second blade element 15*b* is formed as described above, so that air, which has reached the inner peripheral part 13*a* of the negative pressure surface 12*n* of the blade 12, passes through the first opening 16, and flows between the first blade element 15*a* and the second blade element 15*b* to smoothly pass through from the negative pressure side N to the positive pressure side P. Accordingly, the wind speed at the inner peripheral part 13*a* of the blade 12, is increased. The second blade element 15*b* includes a portion projecting toward the negative pressure surface 12*n* side of the blade surface part 12*c*, so that air, which flows from the negative pressure side N, is guided to the first opening 16, wind flows toward the positive pressure side P along the second blade element 15*b*, and the wind speed at the inner peripheral part 13*a* of the blade 12, is further increased.

A second opening 17, which passes through the blade surface part 12*c* from the negative pressure side N toward the positive pressure side P, is provided between the rear edge 12-R of the blade 12 and the second blade element 15*b* on the blade surface part 12*c*. That is, the second opening 17 is a through hole that passes through the blade surface part 12*c*. The second opening 17 is extended to the vicinity of the outer edge E2 of the second blade element 15*b* from the side surface 11*a* of the hub 11 toward the outer edge 12*b* side of the blade surface part 12*c*. As illustrated in FIG. 6, the second opening 17 opens to be continuous to the blade surface of the second blade element 15*b* when viewed from the direction along the center axis O. As illustrated in FIG. 8, on the negative pressure surface 12*n* of the blade 12, an inclined surface 20, which is smoothly continuous to an opening edge of the second opening 17 on the positive pressure surface 12*p*, is formed. The second opening 17 is formed on the blade surface part 12*c* as described above, so that air, which flows from the negative pressure side N toward the positive pressure side P, passes through the second opening 17, and flows along the second blade element 15*b*. Accordingly, the wind speed at the inner peripheral part 13*a* on the rear edge 12-R side of the blade 12, is increased.

As a result, the wind speed at the inner peripheral part 13*a* is increased in the propeller fan 5 according to the present embodiment including the first blade element 15*a*, the second blade element 15*b*, the first opening 16, and the second opening 17 as compared with a case in which the first blade element 15*a*, the second blade element 15*b*, the first opening 16, and the second opening 17 are not included therein. The inner peripheral blade 15 according to the first embodiment includes two blade elements, that is, the first blade element 15*a* and the second blade element 15*b*, but may be formed to include three or more blade elements.

Curved Shape of First Blade Element and Second Blade Element

Figure 10:
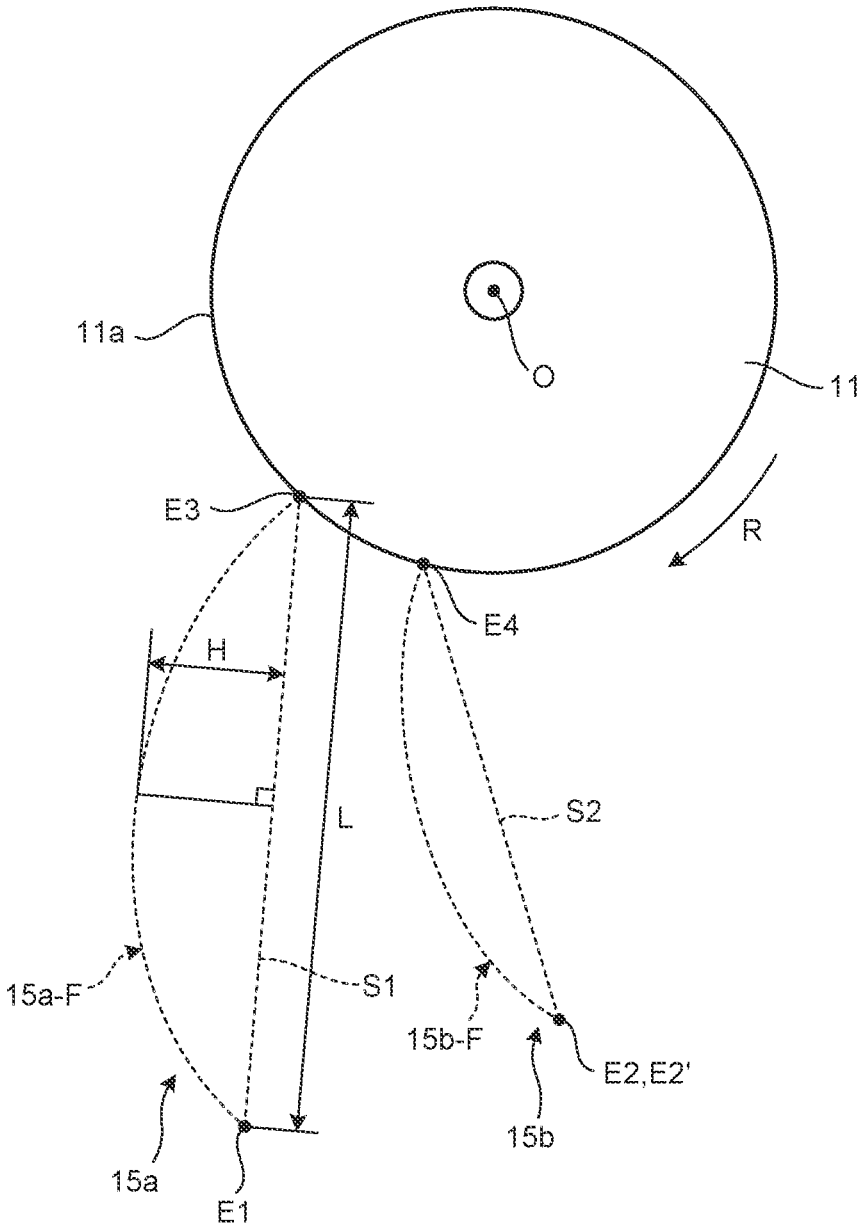
FIG. 10 is a schematic diagram for explaining a curved shape of a first blade element and the second blade element of the inner peripheral blade of the propeller fan according to the first embodiment.

FIG. 10 is a schematic diagram for explaining a curved shape of the first blade element 15*a* and the second blade element 15*b* of the inner peripheral blade 15 of the propeller fan 5 according to the first embodiment. As illustrated in FIG. 6 and FIG. 10, the first blade element 15*a* projects from the positive pressure surface 12*p* of the blade surface part 12*c* toward the positive pressure side P, and is formed in a curved shape so that a front edge 15*a*-F in the rotation direction R of the first blade element 15*a* projects toward the front edge 12-F side of the blade 12. More specifically, the front edge 15*a*-F of the first blade element 15*a* is formed in a curved shape to be separated from a first reference line S1 illustrated in FIG. 10 toward the front edge 12-F side of the blade 12, the first reference line S1 as a straight line connecting a lower end E3 positioned on the positive pressure surface 12*p* at a base end of the first blade element 15*a* connected to the side surface 11*a* of the hub 11 with the outer edge E1 of the first blade element 15*a* positioned on positive pressure surface 12*p*.

Similarly to the first blade element 15*a*, the second blade element 15*b* projects from the positive pressure surface 12*p* of the blade surface part 12*c* toward the positive pressure side P, and is formed in a curved shape so that the front edge 15*b*-F in the rotation direction R of the second blade element 15*b* projects toward the front edge 12-F side (the first blade element 15*a* side) of the blade 12. More specifically, as illustrated in FIG. 10, the front edge 15*b*-F of the second blade element 15*b* is formed in a curved shape to be separated from a second reference line S2 toward the first blade element 15*a* side (the front edge 12-F side of the blade 12), the second reference line S2 as a straight line connecting a lower end E4 at which the front edge 15*b*-F is positioned at the base end of the second blade element 15*b* connected to the side surface 11*a* of the hub 11 with the outer edge E2 of the front edge 15*b*-F of the second blade element 15*b*.

The second blade element 15*b* is formed across the positive pressure surface 12*p* and the negative pressure surface 12*n* of the blade surface part 12*c* via the first opening 16. Thus, as illustrated in FIG. 7, the second blade element 15*b* includes the outer edge E2 that is curved toward the rear edge 12-R side of the blade 12 on the positive pressure surface 12*p*, and an outer edge E2' that is curved toward the rear edge 12-R side of the blade 12 on the negative pressure surface 12*n*. Accordingly, a portion 12*d* of the blade surface part 12*c*, which forms the edge of the first opening 16, extends toward the side surface 11*a* side of the hub 11 along the blade surface on the first blade element 15*a* side of the second blade element 15*b*. In the second blade element 15*b* according to the first embodiment, the outer edge E2 on the positive pressure surface 12*p* and the outer edge E2' on the negative pressure surface 12*n* (refer to FIG. 10) are formed at the same position in the radial direction of the center axis O.

Although not illustrated, similarly to the front edge 15*a*-F of the first blade element 15*a*, the front edge 15*b*-F of the second blade element 15*b* may be formed such that the front edge 15*b*-F is positioned on the positive pressure surface 12*p*. In this case, the front edge 15*b*-F of the second blade element 15*b* is formed in a curved shape to be separated from the second reference line S2 toward the first blade element 15*a* side, the second reference line S2 connecting the lower end E4 positioned on the positive pressure surface 12*p* at the base end of the second blade element 15*b* connected to the side surface 11*a* of the hub 11 with the outer edge E2 of the second blade element 15*b* positioned on the positive pressure surface 12*p*.

The curved shape of the first blade element 15*a* formed as described above satisfies:

$$H/L \geq 0.1 \quad \text{(expression 1)}$$

where L [mm] is the length of the first reference line S1 described above, and H [mm] is a maximum separation distance as a maximum value of a distance between the first reference line S1 and the front edge 15*a*-F of the first blade element 15*a* (a length to an intersection point with the front edge 15*a*-F on a perpendicular to the first reference line S1).

Figure 11:
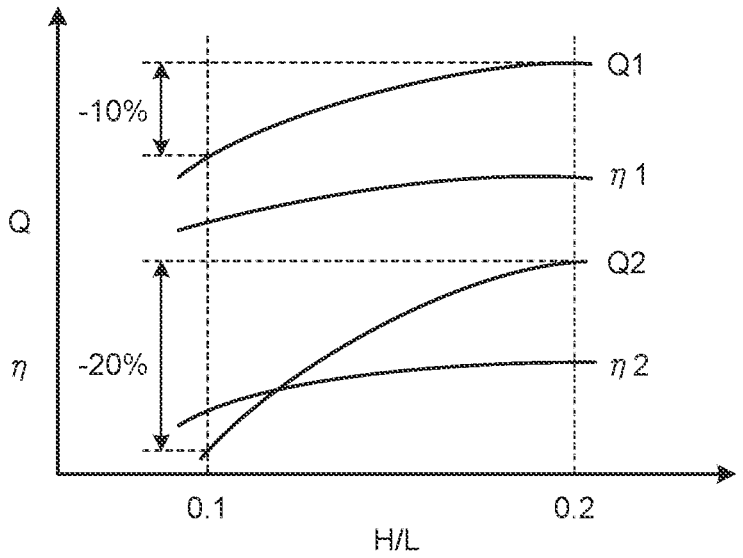
FIG. 11 is a graph for explaining a relation between H/L of the first blade element of the propeller fan according to the first embodiment, and an air volume and efficiency of the propeller fan.

FIG. 11 is a graph for explaining a relation between H/L of the first blade element 15*a* of the propeller fan 5 according to the first embodiment, and an air volume and efficiency of the propeller fan 5. In FIG. 11, a horizontal axis indicates a value of H/L of the first blade element 15*a*, and the value of H/L ranges from 0.1 to 0.2 in FIG. 11. A vertical axis indicates an air volume Q [m3/h] and efficiency η (=air volume Q/input) [m3/h/W] of the propeller fan 5. An air volume Q1 and efficiency η1 respectively represent an air volume and efficiency at the time when the propeller fan 5 is rotated with a rated load of the air conditioner, and an air volume Q2 and efficiency η2 respectively represent an air volume and efficiency at the time when the propeller fan 5 is rotated with a higher load than the rated load of the air conditioner. In both cases of the rated load and the higher load, it is preferable that values of efficiency η1 and η2 are not excessively lowered from peak values thereof (values at the time when the value of H/L is 0.2).

As illustrated in FIG. 11, regarding the blade 12 of the propeller fan 5 according to the first embodiment, the air volume at the inner peripheral part 13*a* of the blade 12 can be increased as compared with a structure not including the first blade element 15*a*. In a case of increasing the air volume at the inner peripheral part 13*a*, the value of H/L is preferably equal to or larger than 0.2. When the value of H/L is equal to or larger than 0.1, and smaller than 0.2, air volumes Q1 and Q2 are reduced, but the air volume Q1 is reduced only by 10% (in a case of the rated load), and the air volume Q2 is reduced only by 20% (in a case of the higher load), which fall within a permissible range (when the value of H/L is smaller than 0.1, the air volume Q is reduced, so that a difference in air volume from a structure not including the first blade element 15*a* is small).

Blade Angle of First Blade Element

Figure 12:
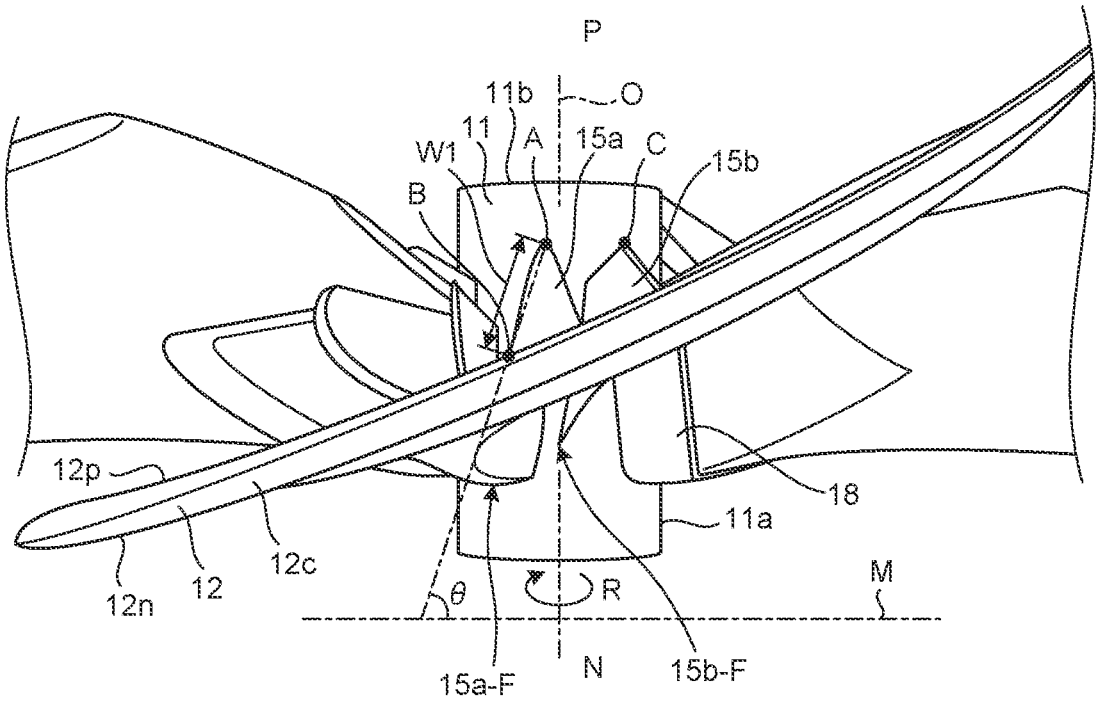
FIG. 12 is a side view for explaining a blade angle of the first blade element of the propeller fan according to the first embodiment.

FIG. 12 is a side view for explaining a blade angle of the first blade element 15*a* of the propeller fan 5 according to the first embodiment. As illustrated in FIG. 6 and FIG. 12, assuming that an apex of the first blade element 15*a* projecting from the positive pressure surface 12*p* of the blade surface part 12*c* is A, a distance from the center axis O to the apex A is r1, and a point, which has a distance r1 from the center axis O at the front edge 15*a*-F in the rotation direction R of the first blade element 15*a*, is B, a total length of the first blade element 15*a* along a direction connecting the apex A with the point B, is assumed to be a chord length W1 of the first blade element 15*a*. In this case, as illustrated in FIG. 12, a blade angle θ of the first blade element 15*a* formed by a direction along a chord of the first blade element 15*a* and a plane M orthogonal to the center axis O (what is called a rotary surface), is formed to fall within a range equal to or larger than a predetermined first angle and equal to or smaller than a second angle that is larger than the first angle. The apex A is a point that is positioned to be the closest to the positive pressure side P in the first blade element 15*a*, the point at which a projecting amount from the positive pressure surface 12*p* is the largest.

Figure 13:
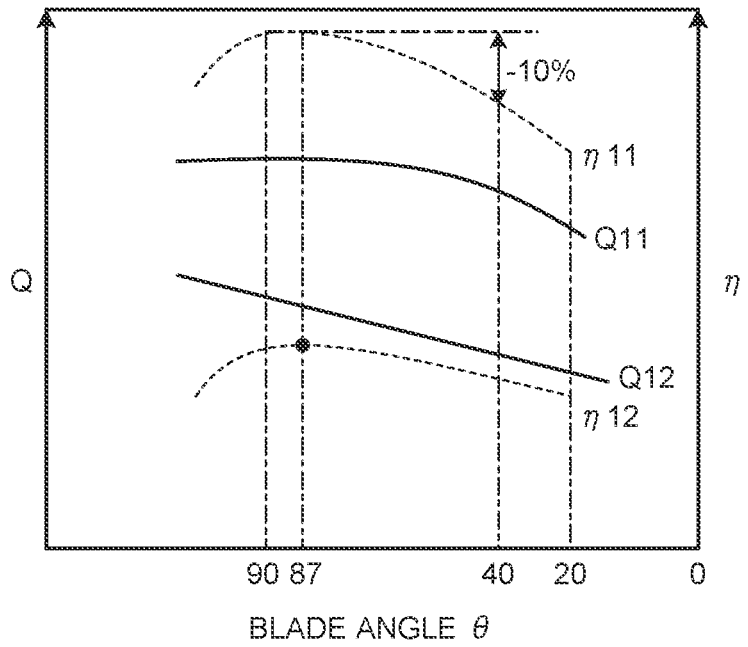
FIG. 13 is a graph for explaining a relation between the blade angle of the first blade element of the propeller fan according to the first embodiment, and an air volume and efficiency.

FIG. 13 is a graph for explaining a relation between the blade angle θ of the first blade element 15*a* of the propeller fan 5 according to the first embodiment, and the air volume and the efficiency of the propeller fan 5. In FIG. 13, a horizontal axis indicates the blade angle θ of the first blade element 15*a*, and a vertical axis indicates the air volume Q [m3/h] and the efficiency η [m3/h/W] of the propeller fan 5. An air volume Q11 and efficiency η11 respectively represent an air volume and efficiency at the time when the propeller fan 5 is rotated with the rated load of the air conditioner, and an air volume Q12 and efficiency η12 respectively represent an air volume and efficiency at the time when the propeller fan 5 is rotated with a higher load than the rated load of the air conditioner.

As illustrated in FIG. 13, when the blade angle θ of the first blade element 15*a* is 87 degrees, the efficiency η11 in a case of the rated load and the efficiency η12 in a case of the higher load respectively reach peak values. In a case of the rated load, the air volume Q11 of the propeller fan 5 reaches a peak value when the blade angle θ of the first blade element 15*a* is 87 degrees. In a case of the rated load, when the blade angle θ is caused to fall within a range equal to or larger than 40 degrees as the first angle, and equal to or smaller than 90 degrees as the second angle, reduction of the efficiency η11 of the propeller fan 5 from the peak value is suppressed to be about 10%. In a case of the higher load, even in a case in which the blade angle of the first blade element is 20 degrees, reduction of the efficiency η12 of the propeller fan 5 from the peak value is suppressed to be lower than 10%.

Thus, with the blade 12 of the propeller fan 5 according to the first embodiment, the air volume at the inner peripheral part 13*a* of the blade 12 can be increased as compared with that of a structure not including the first blade element 15*a*, but the air volume Q11 and the efficiency η11 in a case of the rated load and the efficiency η12 in a case of the higher load can be caused to reach peak values by causing the blade angle θ of the first blade element 15*a* to be 87 degrees. With the propeller fan 5 according to the first embodiment, the air volume Q11, the efficiency η11, and the efficiency η12 reach the peak values when the blade angle θ of the first blade element 15*a* is 87 degrees, but the values are characteristic values that vary depending on dimensions, the shape, and the like of the propeller fan.

If the range of the blade angle θ of the first blade element 15*a* is equal to or larger than 20 degrees as the first angle, and equal to or smaller than 90 degrees as the second angle, an effect of increasing the air volume Q11 and the efficiency η11 of the propeller fan 5 in a case of the rated load and the air volume Q12 and the efficiency η12 in a case of the higher load, can be obtained. Considering that reduction of the values of efficiency η11 and η12 from the peak values thereof is suppressed to be about 10% at both of the time when the rated load is applied to the propeller fan 5 and the time when the higher load is applied thereto, the range of the blade angle θ of the first blade element 15*a* is preferably equal to or larger than 40 degrees as the first angle, and equal to or smaller than 90 degrees as the second angle. The blade angle of the second blade element 15*b* may also be formed in substantially the range as that of the blade angle θ of the first blade element 15*a*.

Chord Length of First Blade Element and Second Blade Element

A chord length W1 of the first blade element 15*a* is the total length of the first blade element 15*a* along the direction connecting the apex A with the point B as described above. As illustrated in FIG. 6, in the second blade element 15*b*, similarly to the chord length W1 of the first blade element 15*a*, assuming that an apex of the second blade element 15*b* projecting from the positive pressure surface 12*p* of the blade surface part 12*c* is C, a distance from the center axis O to the apex C is r2, and a point having a distance r2 from the center axis O at the front edge 15*b*-F in the rotation direction R of the second blade element 15*b* is D, the total length of the second blade element 15*b* along a direction connecting the apex C with the point D, is assumed to be a chord length W2 of the second blade element 15*b*. The apex C is a point that is positioned to be the closest to the positive pressure side P in the second blade element 15*b*, the point at which a projecting amount from the positive pressure surface 12*p*, is the largest. The chord length W1 of the first blade element 15*a* is assumed to be longer than the chord length W2 of the second blade element 15*b*.

As described above, the front edge 15*b*-F of the second blade element 15*b* projects from the negative pressure surface 12*n* toward the negative pressure side N, so that the chord length W2 of the second blade element 15*b* is the total length, which includes a portion extending from the negative pressure surface 12*n* of the blade surface part 12*c* toward the negative pressure side N and a portion extending from the positive pressure surface 12*p* toward the positive pressure side P.

Size of First Blade Element and Second Blade Element

Figure 14:
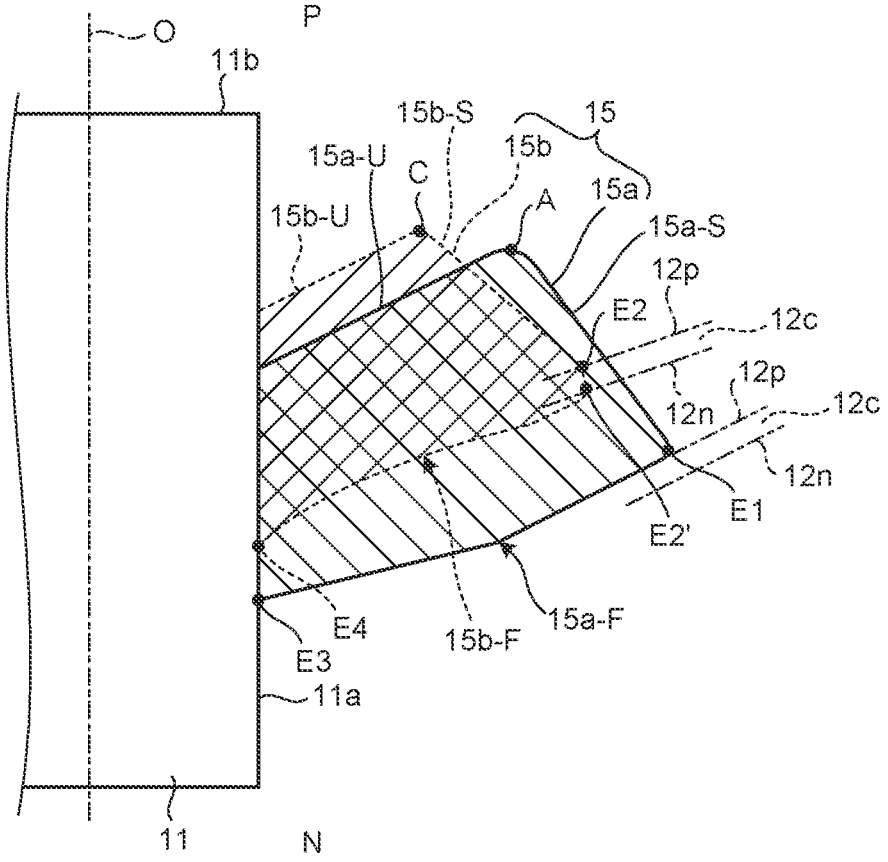
FIG. 14 is a schematic diagram for explaining sizes of the first blade element and the second blade element of the propeller fan according to the first embodiment.

FIG. 14 is a schematic diagram for explaining sizes of the first blade element 15*a* and the second blade element 15*b* of the propeller fan 5 according to the first embodiment. As illustrated in FIG. 14, when the first blade element 15*a* and the second blade element 15*b* are projected on a plane (sheet surface of FIG. 14) along the center axis O of the hub 11, that is, on a meridional cross section of the propeller fan 5 (cross section obtained by cutting the propeller fan 5 along the center axis O), an area of a portion in which the first blade element 15*a* is overlapped with the second blade element 15*b* on the meridional cross section, is equal to or smaller than 75% of an area of the first blade element 15*a* on the meridional cross section.

In the direction along the center axis O of the hub 11, the position of the apex C of the second blade element 15*b* is closer to the positive pressure side P than the position of the apex A of the first blade element 15*a* is. In other words, the position of the apex C of the second blade element 15*b* is closer to an end face 11*b* of the hub 11 on the positive pressure side P than the position of the apex A of the first blade element 15*a* is.

As illustrated in FIG. 5 and FIG. 14, the first blade element 15*a* includes an upper edge 15*a*-U extending from the side surface 11*a* of the hub 11 to the apex A while gradually coming closer to the positive pressure side P, and a side edge 15*a*-S extending from the apex A to the outer edge E1 of the first blade element 15*a* on the positive pressure surface 12*p*. Similarly to the first blade element 15*a*, the second blade element 15*b* includes an upper edge 15*b*-U extending from the side surface 11*a* of the hub 11 to the apex C while gradually coming closer to the positive pressure side P, and a side edge 15*b*-S extending from the apex C to the outer edge E2 of the second blade element 15*b* on the positive pressure surface 12*p*.

Figure 15:
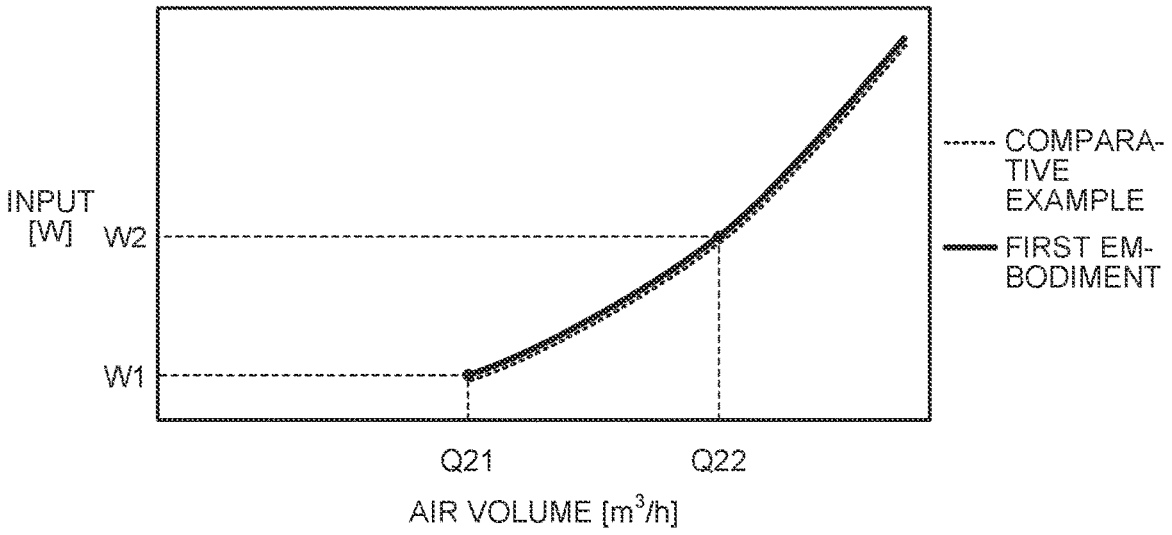
FIG. 15 is a graph illustrating a relation between an input and an air volume of the propeller fan according to the first embodiment.
Figure 16:
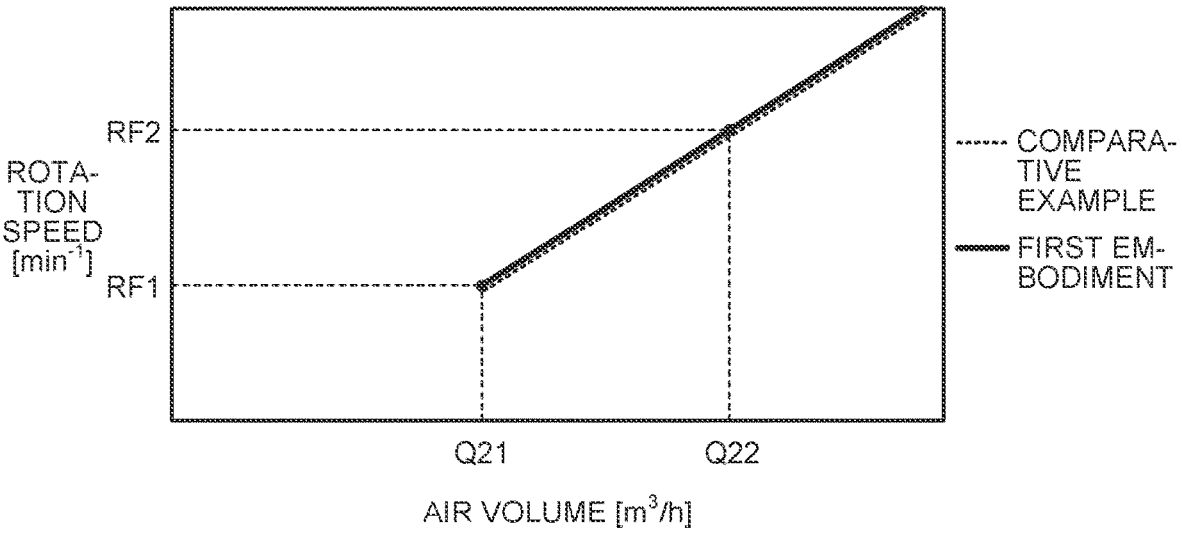
FIG. 16 is a graph illustrating a relation between a rotation speed and an air volume of the propeller fan according to the first embodiment.
Figure 17:
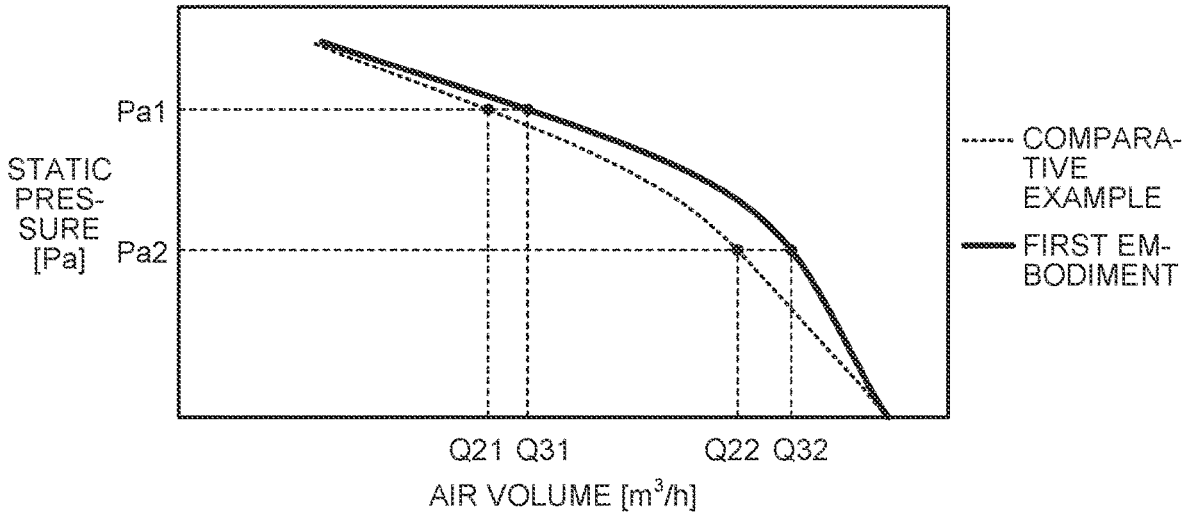
FIG. 17 is a graph illustrating a relation between a static pressure and an air volume of the propeller fan according to the first embodiment.

Comparison of Static Pressure of Propeller Fan Between First Embodiment and Comparative Example The following describes a change in static pressure of the propeller fan between the first embodiment and a comparative example with reference to FIG. 15 to FIG. 17. A propeller fan according to the comparative example is different from the propeller fan 5 according to the first embodiment in that the inner peripheral blade 15 is not included therein. FIG. 15 is a graph illustrating a relation between an input and the air volume of the propeller fan 5 according to the first embodiment. FIG. 16 is a graph illustrating a relation between a rotation speed and the air volume of the propeller fan 5 according to the first embodiment. FIG. 17 is a graph illustrating a relation between the static pressure and the air volume of the propeller fan 5 according to the first embodiment. In FIG. 15 to FIG. 17, the first embodiment is indicated by a solid line, and the comparative example is indicated by a dotted line. In FIG. 15 and FIG. 16, the static pressure is assumed to be the same (constant) in comparing the air volume with respect to the input or the air volume with respect to the rotation speed between the first embodiment and the comparative example.

FIG. 15 illustrates that the input (input power) is W1 [W] when the air volume of the propeller fan is Q21 [$m^3$/h], and the input (input power) is W2 [W] when the air volume of the propeller fan is Q22 [$m^3$/h]. In this case, the air volume Q22 is larger than the air volume Q21. FIG. 16 illustrates that the rotation speed is RF1 [$min^{-1}$] when the air volume of the propeller fan is Q21 [$m^3$/h], and the rotation speed is RF2 [$min^{-1}$] when the air volume of the propeller fan is Q22 [$m^3$/h]. In this case, the rotation speed RF2 is higher than the rotation speed RF1. That is, if at the same air volume, the input (input power) and the rotation speed are the same in the first embodiment and the comparative example. In FIG. 15 and FIG. 16, the solid line indicating the first embodiment and the dotted line indicating the comparative example, which are the same, are illustrated to be shifted from each other to enable each input-air volume characteristic and each rotation speed-air volume characteristic to be clearly seen.

On the other hand, as illustrated in FIG. 17, the air volume of the propeller fan is Q21 [$m^3$/h] in the comparative example, and Q31 [$m^3$/h] in the first embodiment in a case in which the static pressure is Pa1 [Pa], so that the value of the air volume Q31 in the first embodiment is higher than the value of the air volume Q21 in the comparative example. In a case in which the static pressure is Pa2 [Pa], the air volume of the propeller fan is Q22 [$m^3$/h] in the comparative example, and Q32 [$m^3$/h] in the first embodiment, so that the value of the air volume Q32 in the first embodiment is higher than the value of the air volume Q22 in the comparative example.

That is, when at the same static pressure of Pa1 [Pa], the air volume is increased from Q21 [$m^3$/h] to Q31 [$m^3$/h] in the first embodiment as compared with the comparative example. When the static pressure is the same at Pa2 [Pa], the air volume is increased from Q22 [$m^3$/h] to Q32 [$m^3$/h] in the first embodiment as compared with the comparative example. In other words, in the first embodiment, even in a case in which the static pressure is higher than that in the comparative example, the same air volume as that in the comparative example can be secured. That is, as illustrated in FIG. 17, according to the first embodiment, the air volume of the propeller fan 5 can be increased. Also in FIG. 17, the static pressure is assumed to be the same (constant) in comparing the air volume with respect to the input or the air volume with respect to the rotation speed between the first embodiment and the comparative example.

Thus, the inner peripheral blade 15, which is included in the propeller fan 5 according to the first embodiment, is caused to have the shape of the inner peripheral blade 15 and the shape having the blade angle θ as described above, and in a case in which the propeller fan 5 includes a plurality of the inner peripheral blades 15, the first opening 16 is disposed between the inner peripheral blades 15, and a relative relation between the shapes of the inner peripheral blades 15 satisfies a predetermined relation to increase the air volume at the inner peripheral part 13*a* of the propeller fan 5. That is, each of the characteristics described above increases the wind speed at the inner peripheral part 13*a* of the propeller fan 5, and contributes to increasing the air volume at the inner peripheral part 13*a*.

Figure 18:
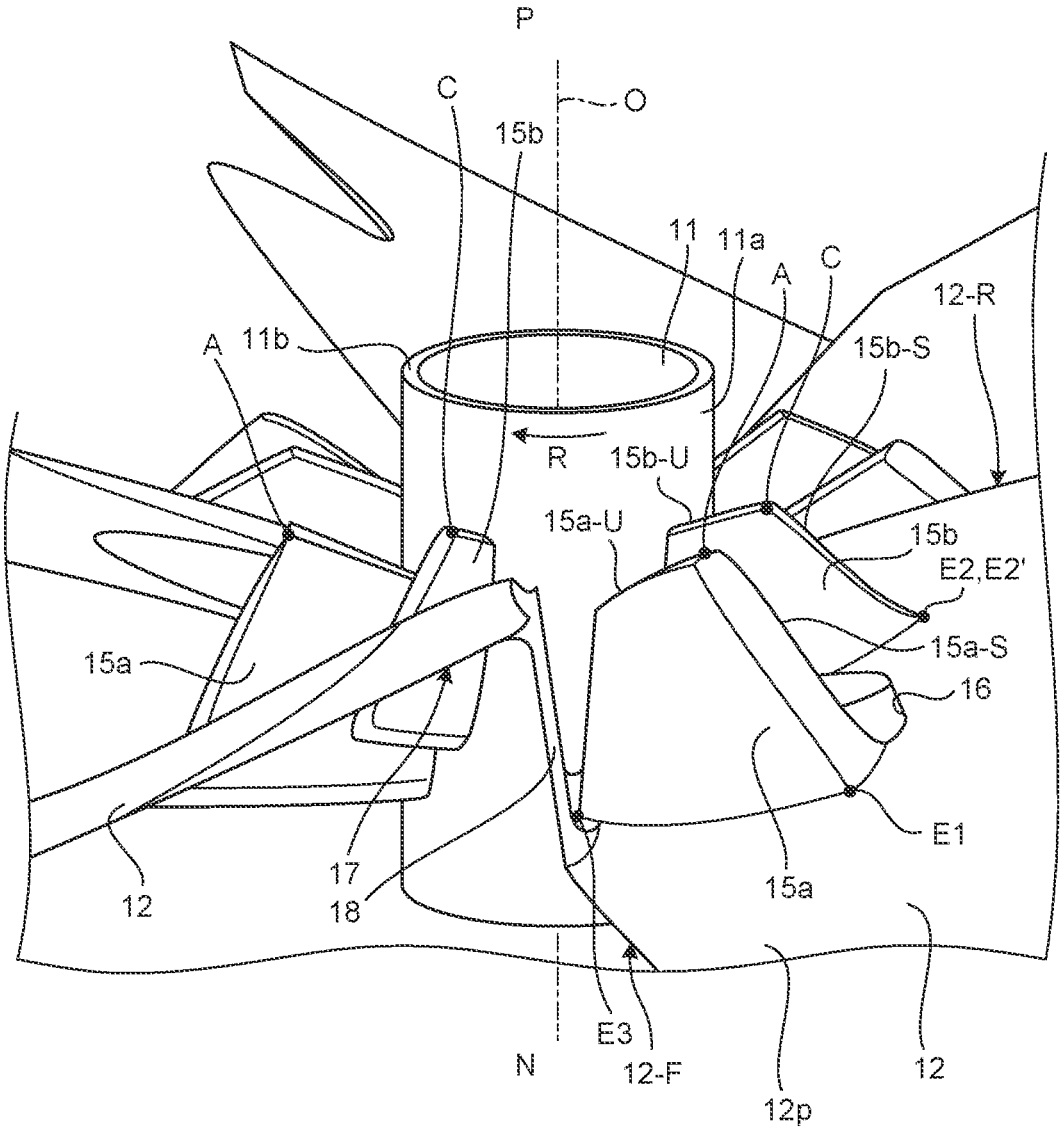
FIG. 18 is an enlarged side view of a principal part for explaining a rib of the blade of the propeller fan according to the first embodiment.

FIG. 18 is an enlarged side view of a principal part for explaining a rib of the blade 12 of the propeller fan 5 according to the first embodiment. As illustrated in FIG. 18, a rib 18 is formed on the side surface 11*a* of the hub 11, the rib 18 serving as a reinforcing member that couples the rear edge 12-R of the blade 12 with the front edge 12-F of the next blade 12 adjacent to the rear edge 12-R. The rib 18 is formed between the rear edge 12-R and the front edge 12-F of each of the blades 12, and formed in a plate shape to couple the rear edge 12-R with the front edge 12-F. A front surface of the rib 18 opposed to the second blade element 15*b* is formed to be continuous to the second opening 17.

For example, when the size of the entire blade 12 is reduced as the number of the blades 12 is increased, and the second opening 17 is formed on the blade surface part 12*c*, mechanical strength of a portion of the blade 12 between the second opening 17 and the rear edge 12-R of the blade 12, may be lowered. Even in such a case, when the rib 18 is formed between the adjacent blades 12, the rear edge 12-R of the blade 12 can be appropriately reinforced by the rib 18. In other words, when the rib 18 is disposed, the second opening 17 can be secured to be large on the blade surface part 12*c*.

Effect of First Embodiment

As described above with reference to FIG. 6, the first opening 16, which passes through the blade surface part 12*c* from the negative pressure side N toward the positive pressure side P, is provided between the first blade element 15*a* and the second blade element 15*b* on the blade surface part 12*c* of the propeller fan 5 according to the first embodiment, and the chord length W1 of the first blade element 15*a* along the direction connecting the apex A with the point B, is equal to or larger than the chord length W2 of the second blade element 15*b* along the direction connecting the apex C with the point D. Due to this, the wind speed at the inner peripheral part 13*a* of the blade 12 is enabled to be increased, and the air volume at the inner peripheral part 13*a* of the blade 12 can be increased, so that the air volume of the entire propeller fan can be increased. The air volume of the propeller fan 5 is increased as compared with a propeller fan not including the inner peripheral blade 15 at the same rotation speed, so that the rotation speed can be reduced to obtain the same air volume as that of the propeller fan not including the inner peripheral blade 15. Accordingly, efficiency of the propeller fan 5 is improved, and energy saving performance of the air conditioner can be improved.

In the propeller fan 5 according to the first embodiment, when the first blade element 15*a* and the second blade element 15*b* are projected on a meridional cross section, which is a plane along the center axis O of the hub 11, as described above with reference to FIG. 14, the area of the portion in which the first blade element 15*a* is overlapped with the second blade element 15*b* on the meridional cross section, is equal to or smaller than 75% of the area of the first blade element 15*a* on the meridional cross section. Due to this, the wind speed at the inner peripheral part 13*a* of the propeller fan 5 can be further increased, and the air volume at the inner peripheral part 13*a* is further increased.

In the inner peripheral blade 15 of the propeller fan 5 according to the first embodiment, as described above with reference to FIG. 14, the position of the apex C of the second blade element 15*b* is closer to the positive pressure side P than the position of the apex A of the first blade element 15*a* in the direction along the center axis O of the hub 11 is. Due to this, the wind speed at the inner peripheral part 13*a* of the propeller fan 5 can be further increased.

As described above with reference to FIG. 7 and FIG. 9, the second blade element 15*b* of the propeller fan 5 according to the first embodiment, is formed across the positive pressure surface 12*p* and the negative pressure surface 12*n* of the blade surface part 12*c* via the first opening 16. In a case of disposing the second blade element 15*b* on the blade 12, the first opening 16 and the second blade element 15*b* share part of the structure. However, in a case of simply arranging the second blade element 15*b* on the blade 12, part of the second blade element 15*b* may have a shape of blocking the first opening 16. Thus, the second blade element 15*b* is formed across the positive pressure surface 12*p* and the negative pressure surface 12*n* of the blade surface part 12*c* via the first opening 16 to enable air to smoothly flow from the negative pressure side N to the positive pressure side P. Due to this, the second blade element 15*b* enables air to easily flow from the negative pressure side N to the positive pressure side P through the first opening 16, so that the wind speed at the inner peripheral part 13*a* of the blade 12 can be further increased.

As described above with reference to FIG. 6, the second opening 17, which passes through the blade surface part 12*c* from the negative pressure side N toward the positive pressure side P, is provided between the rear edge 12-R in the rotation direction R of the blade 12 and the second blade element 15*b* on the blade surface part 12*c* of the blade 12 of the propeller fan 5 according to the first embodiment. Due to this, air is enabled to easily flow from the negative pressure side N to the positive pressure side P at the inner peripheral part 13*a* of the blade 12, and turbulence is prevented from being generated at the inner peripheral part 13*a*, so that the wind speed at the inner peripheral part 13*a* can be increased.

As described above with reference to FIG. 18, the rib 18 is formed on the side surface 11*a* of the hub 11 of the propeller fan 5 according to the first embodiment, the rib 18 coupling the rear edge 12-R in the rotation direction R of the blade 12 with the front edge 12-F of the next blade 12 adjacent to the rear edge 12-R. Due to this, the mechanical strength of the rear edge 12-R of the blade 12 can be prevented from being lowered, due to the second opening 17 formed on the blade surface part 12*c*.

The following describes another embodiment with reference to the drawings. In a second embodiment, the same constituent member as that in the first embodiment described above, is denoted by the same reference numeral as that in the first embodiment, and description thereof will not be repeated.

Second Embodiment

The blade 12 of a propeller fan 25 according to the second embodiment has a characteristic such that a first blade element 35*a* and a second blade element 35*b* of an inner peripheral blade 35 (described later) project from the negative pressure surface 12*n* toward the negative pressure side N. In the propeller fan 5 according to the first embodiment, the front edge 15*a*-F of the first blade element 15*a* and the front edge 15*b*-F of the second blade element 15*b* slightly project from the negative pressure surface 12*n* toward the negative pressure side N (FIG. 12). However, the first blade element 35*a* and the second blade element 35*b* in the second embodiment are different from those in the first embodiment in that a projecting amount thereof from the negative pressure surface 12*n* toward the negative pressure side N is secured to be larger than that in the first embodiment.

Shape of Inner Peripheral Blade

Figure 19:
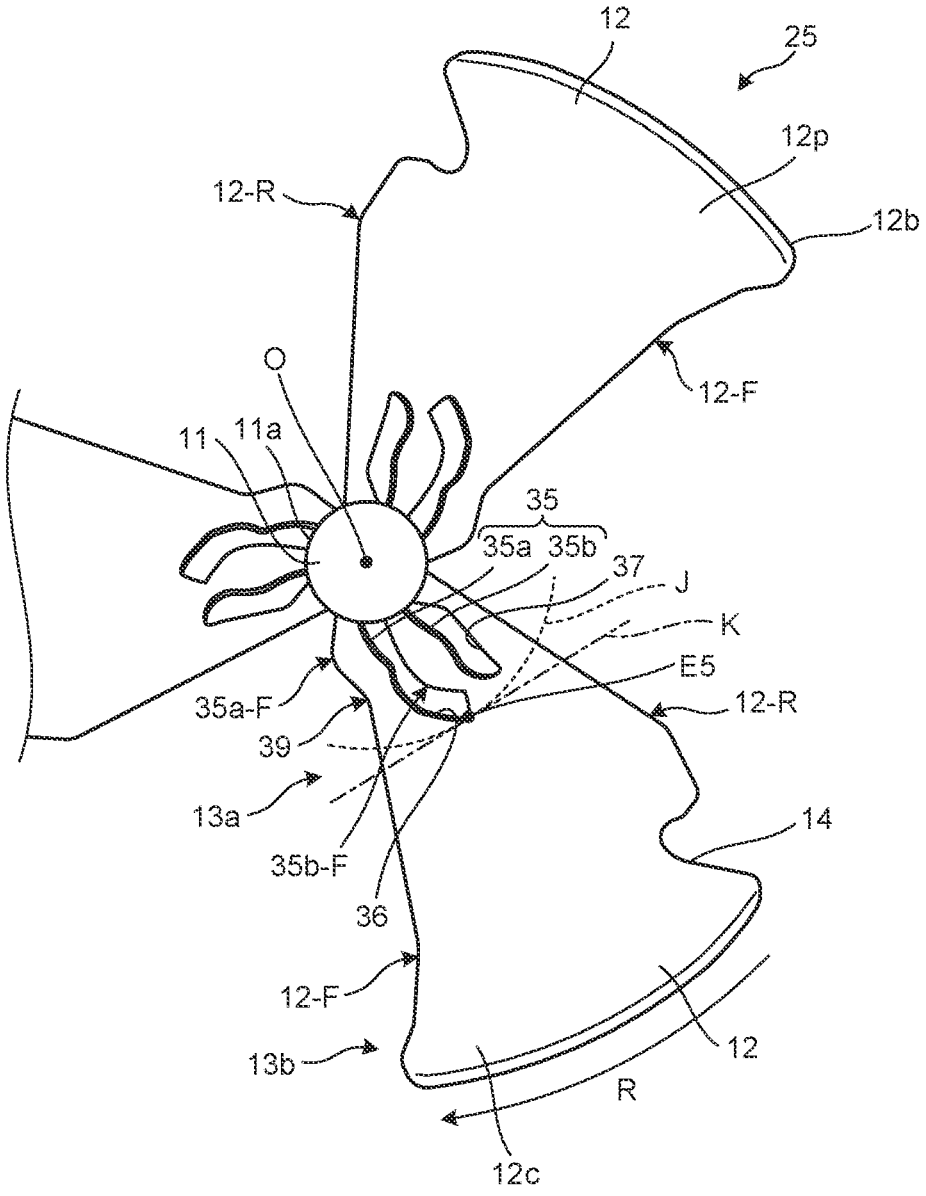
FIG. 19 is a plan view of a propeller fan according to a second embodiment, viewed from the positive pressure side.
Figure 20:
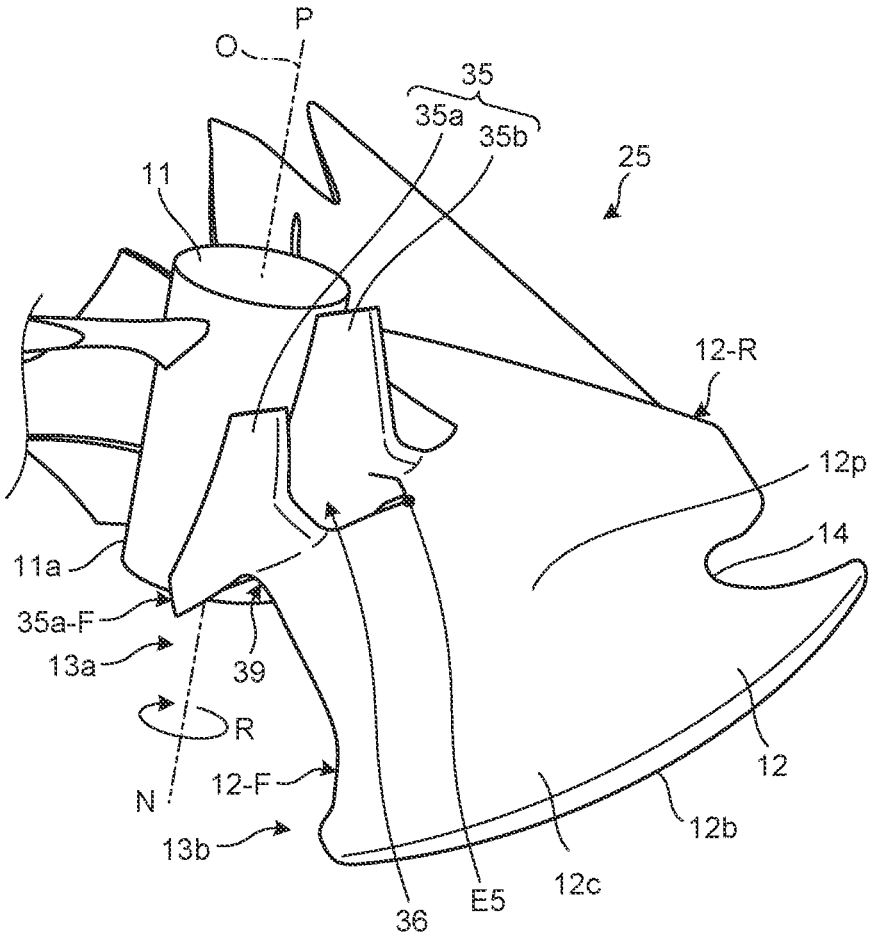
FIG. 20 is a perspective view of a first blade element and a second blade element of the propeller fan according to the second embodiment, viewed from the positive pressure side.
Figure 21:
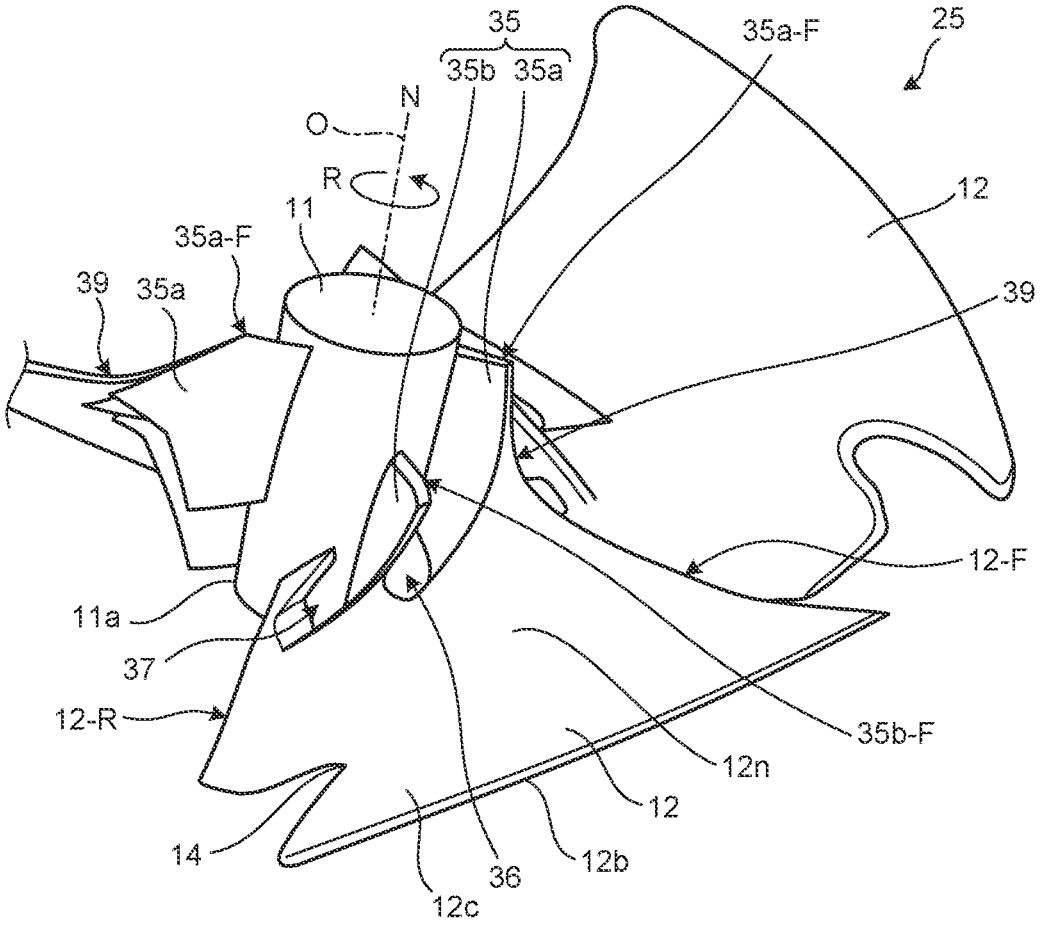
FIG. 21 is a perspective view of the first blade element and the second blade element of the propeller fan according to the second embodiment, viewed from the negative pressure side.

FIG. 19 is a plan view of the propeller fan 25 according to the second embodiment, viewed from the positive pressure side P. FIG. 20 is a perspective view of the first blade element 35*a* and the second blade element 35*b* of the propeller fan 25 according to the second embodiment, viewed from the positive pressure side P. FIG. 21 is a perspective view of the first blade element 35*a* and the second blade element 35*b* of the propeller fan 25 according to the second embodiment, viewed from the negative pressure side N.

As illustrated in FIG. 19, FIG. 20, and FIG. 21, the inner peripheral blade 35 of the propeller fan 25 according to the second embodiment projects from the positive pressure surface 12*p* of the blade surface part 12*c* toward the positive pressure side P, and includes the first blade element 35*a* and the second blade element 35*b* that are arranged side by side along the rotation direction R of the blade 12.

As illustrated in FIG. 19 and FIG. 20, a first opening 36, which passes through the blade surface part 12*c* from the negative pressure side N to the positive pressure side P, is provided between the first blade element 35*a* and the second blade element 35*b* on the blade surface part 12*c*. A second opening 37, which passes through the blade surface part 12*c* from the negative pressure side N to the positive pressure side P, is provided between the rear edge 12-R of the blade 12 and the second blade element 35*b* on the blade surface part 12*c*.

Figure 23:
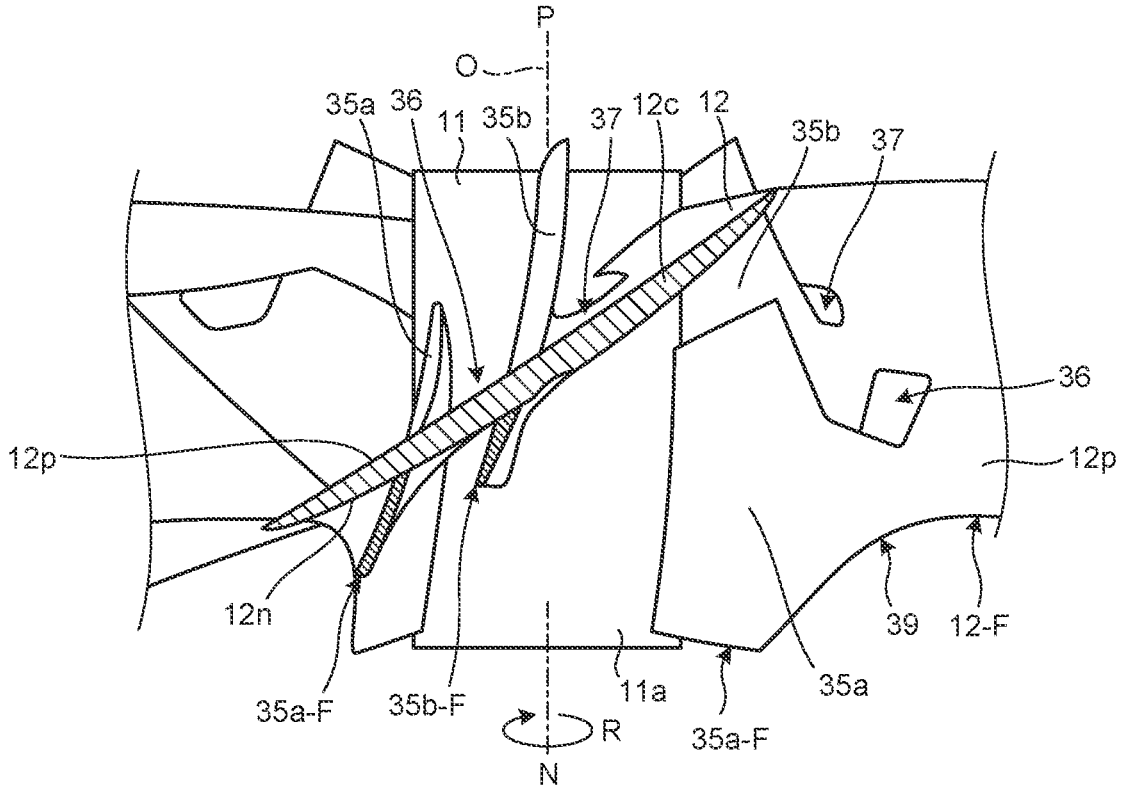
FIG. 23 is a cross-sectional view of a principal part for explaining a shape such that the first blade element and the second blade element of the propeller fan according to the second embodiment project from the negative pressure surface toward the negative pressure side.

The first blade element 35*a* projects from the negative pressure surface 12*n* of the blade surface part 12*c* toward the negative pressure side N, and projects from the positive pressure surface 12*p* of the blade surface part 12*c* toward the positive pressure side P (refer to FIG. 23). As illustrated in FIG. 19, the first blade element 35*a* is formed in a curved shape so that a front edge 35*a*-F in the rotation direction R of the first blade element 35*a* projects toward the front edge 12-F side of the blade 12. As illustrated in FIG. 19 and FIG. 20, the outer peripheral part 13*b* side of the front edge of the first blade element 35*a* is formed to be continuous to the inner peripheral part 13*a* side of the front edge 12-F of the blade surface part 12*c*, and a recessed part 39, which is recessed toward the rear edge 12-R side of the blade 12, is formed at a boundary portion between the front edge 35*a*-F of the first blade element 35*a* and the front edge 12-F of the blade surface part 12*c*.

Similarly to the first blade element 35*a*, the second blade element 35*b* projects from the negative pressure surface 12*n* of the blade surface part 12*c* toward the negative pressure side N, and projects from the positive pressure surface 12*p* of the blade surface part 12*c* toward the positive pressure side P (refer to FIG. 23). As illustrated in FIG. 19, the second blade element 35*b* is formed in a curved shape so that a front edge 35*b*-F in the rotation direction R of the second blade element 35*b* projects toward the front edge 12-F side of the blade 12 (the first blade element 35*a* side). Other shapes of the first blade element 35*a* and the second blade element 35*b* according to the second embodiment, are formed similarly to the respective shapes of the first blade element 15*a* and the second blade element 15*b* in the first embodiment described above.

Principal Part of Second Embodiment

Figure 22:
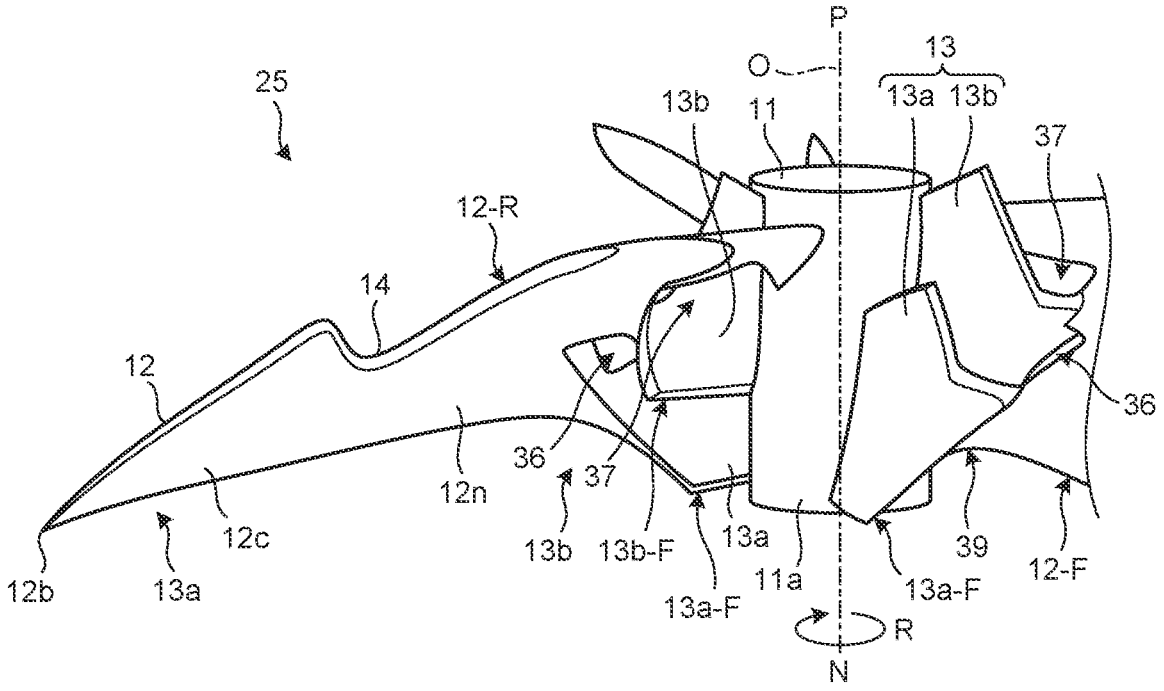
FIG. 22 is a perspective view for explaining a shape of the first blade element and the second blade element of the propeller fan according to the second embodiment projecting from a negative pressure surface toward the negative pressure side.

FIG. 22 is a perspective view for explaining a shape of the first blade element 35*a* and the second blade element 35*b* of the propeller fan 25 according to the second embodiment, projecting from the negative pressure surface 12*n* toward the negative pressure side N. FIG. 23 is a cross-sectional view of a principal part for explaining a shape of the first blade element 35*a* and the second blade element 35*b* of the propeller fan 25 according to the second embodiment, projecting from the negative pressure surface 12*n* toward the negative pressure side N.

As illustrated in FIG. 22 and FIG. 23, the first blade element 35*a* and the second blade element 35*b* project from the negative pressure surface 12*n* of the blade surface part 12*c* toward the negative pressure side N. In other words, the front edge 35*a*-F of the first blade element 35*a* and the front edge 35*b*-F of the second blade element 35*b* are formed to be positioned on the negative pressure side N.

In the second embodiment, both of the first blade element 35*a* and the second blade element 35*b* project from the negative pressure surface 12*n* of the blade surface part 12*c* toward the negative pressure side N. However, only the second blade element 35*b* may project, for example, and the embodiment is not restricted to a structure, in which all of the blade elements of the inner peripheral blade 35 project from the negative pressure surface 12*n* of the blade surface part 12*c* toward the negative pressure side N.

The following describes a definition of a cross section of the blade surface part 12*c* illustrated in FIG. 23 with reference to FIG. 19. As illustrated in FIG. 19, based on a circle J along a circumferential direction of the hub 11 passing through an outer edge E5 of the first opening 36 in a radial direction of the hub 11, a cross section, which is obtained by cutting the blade 12 along a tangent K tangent to the circle J at the outer edge E5, is the cross section illustrated in FIG. 23.

Work of First Blade Element and Second Blade Element

Figure 24:
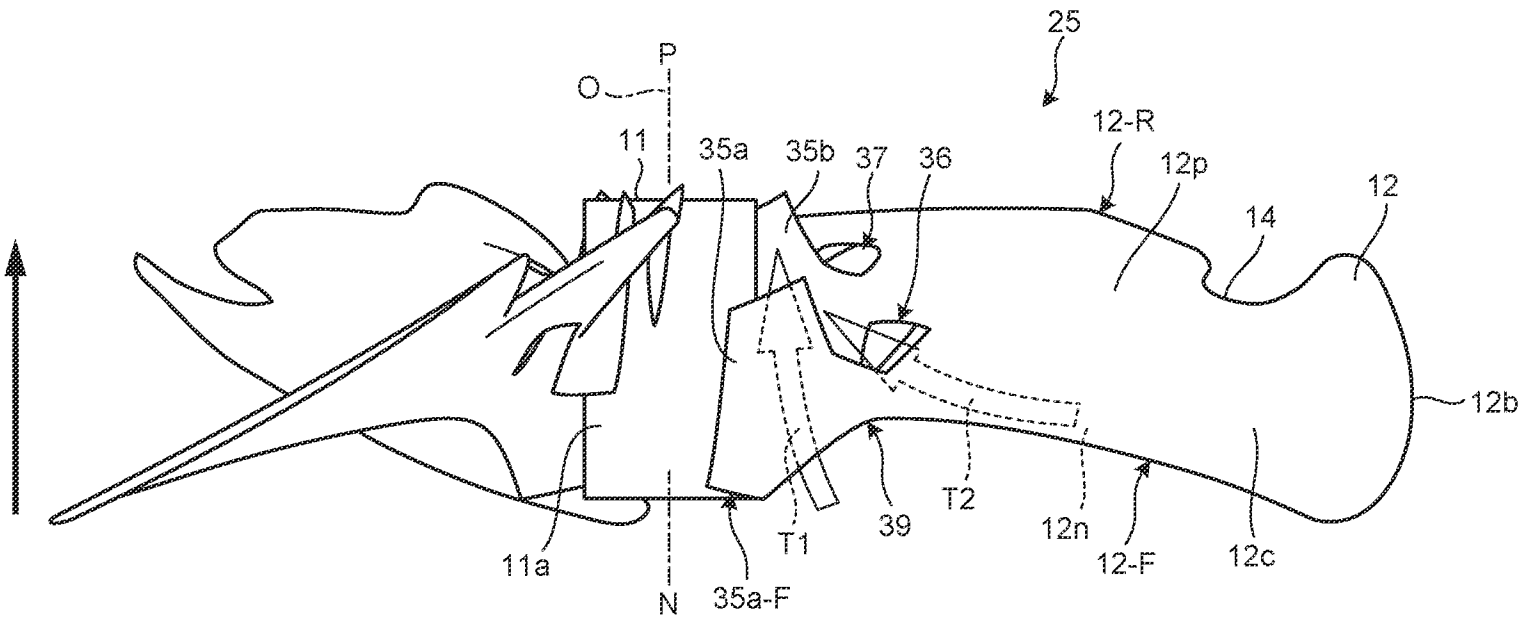
FIG. 24 is a side view for explaining an air flow caused by the first blade element and the second blade element of the propeller fan according to the second embodiment.

FIG. 24 is a side view for explaining an air flow caused by the first blade element 35*a* and the second blade element 35*b* of the propeller fan 25 according to the second embodiment. In the second embodiment, as illustrated in FIG. 24, air flows T1 and T2, which flow from the negative pressure side N toward the positive pressure side P, are generated, but the air flow T2 is different from that in the first embodiment. In the first embodiment, air passing through the first opening 16 flows along respective positive pressure surfaces of the first blade element 15*a* and the second blade element 15*b*. On the other hand, in the second embodiment, projecting amounts of the first blade element 35*a* and the second blade element 35*b*, which project from the negative pressure surface 12*n* toward the negative pressure side N, are appropriately secured, so that air flowing along the negative pressure surface 12*n* is enabled to be easily guided to the first opening 36 like the air flow T2. In the second embodiment, air, which is guided to the first opening 36 along the negative pressure surface 12*n*, is received by the positive pressure surface 12*p* of the second blade element 35*b*, so that the volume of air that is drawn from the negative pressure side N to the positive pressure side P along the second blade element 35*b*, is increased. Accordingly, the wind speed at the inner peripheral part 13*a* of the blade 12 is increased.

The first blade element 35*a* and the second blade element 35*b* according to the second embodiment project from the positive pressure surface 12*p* of the blade surface part 12*c* toward the positive pressure side P, and project from the negative pressure surface 12*n* toward the negative pressure side N. Specifically, the shape of projecting from the negative pressure surface 12*n* toward the negative pressure side N dominantly works on increase in the air volume of the propeller fan 5. Additionally, the shapes of the first blade element 35*a* and the second blade element 35*b* projecting from the positive pressure surface 12*p* toward the positive pressure side P works to increase the wind speed at the inner peripheral part 13*a* of the blade 12, and to increase the air volume at the inner peripheral part 13*a* by increasing each chord length of the first blade element 35*a* and the second blade element 35*b* to be appropriately secured.

Thus, under the condition that each chord length of the first blade element 35*a* and the second blade element 35*b* is constant in the propeller fan 25, by arranging the first blade element 35*a* and the second blade element 35*b* to be closer to the negative pressure side N with respect to the blade surface part 12*c*, so that the projecting amount from the negative pressure surface 12*n* toward the negative pressure side N is further increased, the air volume at the inner peripheral part 13*a* of the blade 12 can be further increased, and the wind speed can be further increased. Additionally, the first blade element 35*a* and the second blade element 35*b* are arranged to be closer to the negative pressure side N of the blade surface part 12*c*, so that an empty space around a rotating shaft of the fan motor can be effectively used. Accordingly, space occupied by the fan motor and the propeller fan 25 in the outdoor unit 1 can be reduced, so that the outdoor unit 1 can be configured to be compact, and the outdoor unit 1 can be downsized.

Comparison Between Second Embodiment and First Embodiment

Figure 25:
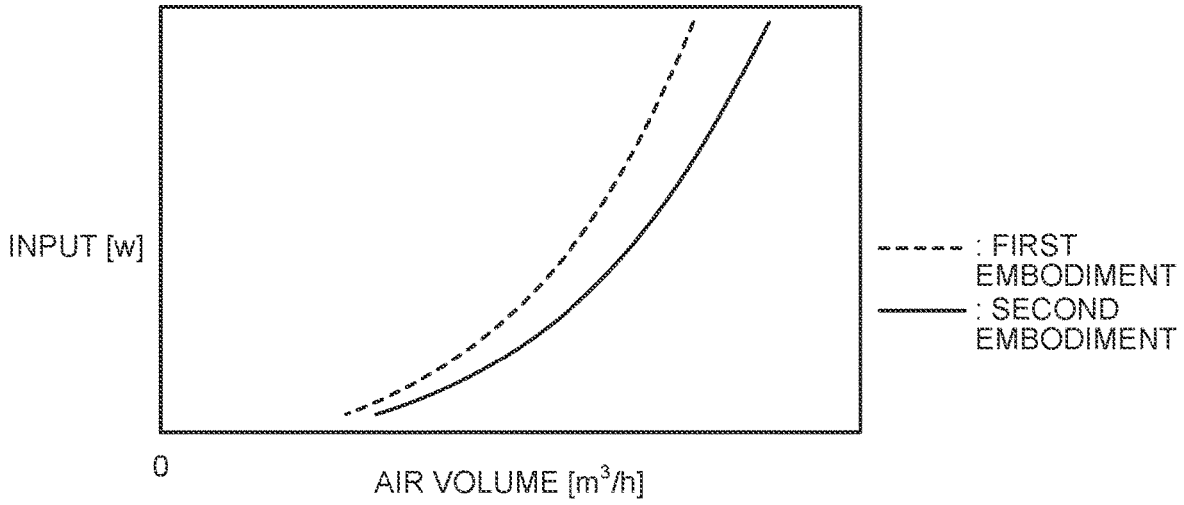
FIG. 25 is a graph illustrating a relation between an input and an air volume of the propeller fan according to the second embodiment as compared with the first embodiment.
Figure 26:
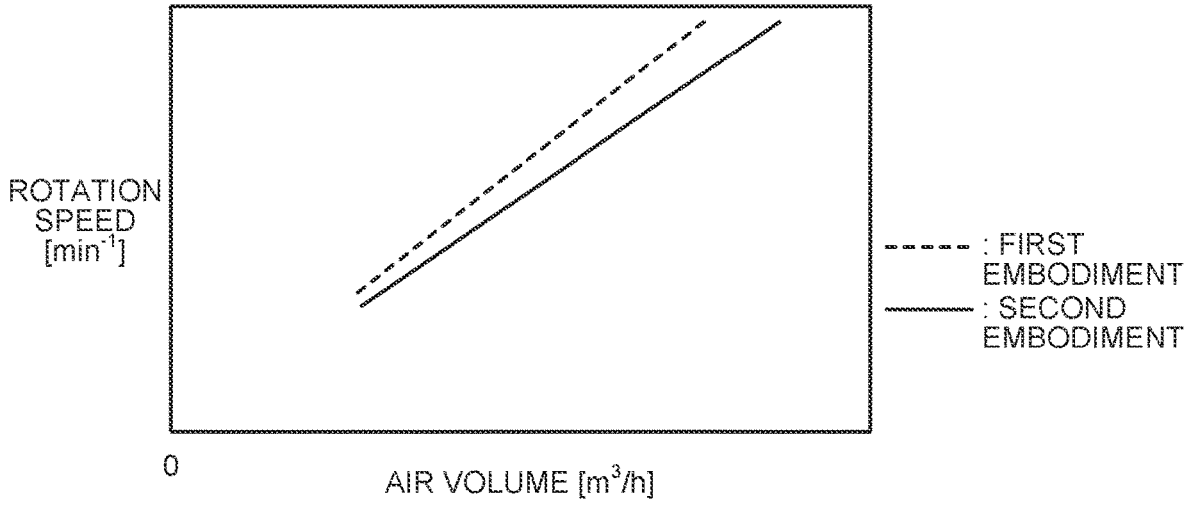
FIG. 26 is a graph illustrating a relation between a rotation speed and an air volume of the propeller fan according to the second embodiment as compared with the first embodiment.

With reference to FIG. 25 and FIG. 26, the following makes a comparison between the propeller fan 25 according to the second embodiment and the propeller fan 5 according to the first embodiment. The propeller fan 5 according to the first embodiment is different from that in the second embodiment in that the projecting amounts of the first blade element 15*a* and the second blade element 15*b*, which project from the negative pressure surface 12*n* toward the negative pressure side N, are smaller than those of the propeller fan 25 according to the second embodiment. FIG. 25 is a graph illustrating a relation between the input and the air volume of the propeller fan 25 according to the second embodiment as compared with the first embodiment. FIG. 26 is a graph illustrating a relation between the rotation speed and the air volume of the propeller fan 25 according to the second embodiment as compared with the first embodiment. In FIG. 25 and FIG. 26, the second embodiment is indicated by a solid line, and the first embodiment is indicated by a dotted line. In FIG. 25 and FIG. 26, the static pressure is assumed to be the same (constant) in comparing the air volume with respect to the input or the air volume with respect to the rotation speed between the second embodiment and the first embodiment.

As illustrated in FIG. 25, in a case in which the input [W] of the fan motor has the same value, the air volume [$m^3$/h] of the propeller fan 25 according to the second embodiment becomes larger than that of the propeller fan 5 according to the first embodiment. As illustrated in FIG. 26, in a case in which the rotation speed [$min^{-1}$] of the fan motor has the same value, the air volume [$m^3$/h] of the propeller fan 25 according to the second embodiment becomes larger than that of the propeller fan 5 according to the first embodiment. Thus, according to FIG. 25 and FIG. 26, it is clear that the wind speed at the inner peripheral part 13*a* of the blade 12 is increased by appropriately securing the projecting amounts of the first blade element 35*a* and the second blade element 35*b*, which project from the negative pressure surface 12*n* toward the negative pressure side N, as in the second embodiment.

Effect of Second Embodiment

The inner peripheral blade 35 of the propeller fan 25 according to the second embodiment, projects from the negative pressure surface 12*n* of the blade surface part 12*c* toward the negative pressure side N, and includes a plurality of blade elements, which are arranged side by side in the rotation direction R of the blade 12. The blade elements include the first blade element 35*a*, which are arranged on the front edge 12-F side of the blade 12, and the second blade element 35*b*, which are arranged to be adjacent to the first blade element 35*a* on the rear edge 12-R side of the blade 12, and the first opening 36, which passes through the blade surface part 12*c* from the negative pressure side N toward the positive pressure side P, is provided between the first blade element 35*a* and the second blade element 35*b* on the blade surface part 12*c*. Due to this, the wind speed at the inner peripheral part 13*a* of the blade 12 is enabled to be increased, and the air volume at the inner peripheral part 13*a* of the blade 12 can be improved, so that the air volume of the entire propeller fan 5 can be increased. Accordingly, efficiency of the propeller fan 5 is improved, and energy saving performance of the air conditioner can be improved.

In the propeller fan 25, by arranging the first blade element 35*a* and the second blade element 35*b* to be closer to the negative pressure side N with respect to the blade surface part 12*c*, so that the projecting amount from the negative pressure surface 12*n* toward the negative pressure side N, is further increased, the air volume at the inner peripheral part 13*a* of the blade 12 can be further increased, and the wind speed can be further increased. Additionally, the first blade element 35*a* and the second blade element 35*b* are arranged to be closer to the negative pressure side N of the blade surface part 12*c*, so that an empty space around the rotating shaft of the fan motor can be effectively used. Due to this, space occupied by the fan motor and the propeller fan 25 in the outdoor unit 1 can be reduced, so that the outdoor unit can be configured to be compact, and the outdoor unit 1 can be downsized.

Furthermore, the first blade element 35*a* and the second blade element 35*b* according to the second embodiment, project from the positive pressure surface 12*p* toward the positive pressure side P similarly to the first blade element 15*a* and the second blade element 15*b* according to the first embodiment. Due to this, each chord length of the first blade element 35*a* and the second blade element 35*b* is increased, and each chord length is appropriately secured, so that the wind speed of air flowing along the first blade element 35*a* and the second blade element 35*b* can be increased, and the air volume at the inner peripheral part 13*a* of the blade 12 can be increased. However, regarding the first blade element 35*a* and the second blade element 35*b*, the shape of projecting from the negative pressure surface 12*n* of the blade surface part 12*c* toward the negative pressure side N, is more important than the shape of projecting from the positive pressure surface 12*p* toward the positive pressure side P, so that the projecting amount toward the negative pressure side N should be appropriately secured to contribute to increasing the air volume.

REFERENCE SIGNS LIST

5, 25 PROPELLER FAN
11 HUB
11*a* SIDE SURFACE
12 BLADE
12-F FRONT EDGE
12-R REAR EDGE
12*a* BASE END
12*b* OUTER EDGE
12*c* BLADE SURFACE PART
12*p* POSITIVE PRESSURE SURFACE
12*n* NEGATIVE PRESSURE SURFACE
13*a* INNER PERIPHERAL PART
13*b* OUTER PERIPHERAL PART
15, 35 INNER PERIPHERAL BLADE
15*a*, 35*a* FIRST BLADE ELEMENT
15*a*-F, 35*a*-F FRONT EDGE
15*b*, 35*b* SECOND BLADE ELEMENT
15B-F, 35B-F FRONT EDGE
16, 36 FIRST OPENING
17, 37 SECOND OPENING
18 RIB (REINFORCING MEMBER)
O CENTER AXIS
R ROTATION DIRECTION
N NEGATIVE PRESSURE SIDE
P POSITIVE PRESSURE SIDE
θ BLADE ANGLE
A, C APEX
E1, E2, E2' OUTER EDGE
E3, E4 LOWER END
r1, r2 DISTANCE
W1, W2 CHORD LENGTH

The invention claimed is:

1. A propeller fan comprising:

a hub including a side surface around a center axis; and a plurality of blades disposed on the side surface of the hub, wherein the blades each include a blade surface part, which is extended from a base end connected to the side surface of the hub to an outer edge, and the blade surface part includes an inner peripheral part, which is positioned on the base end side, and an outer peripheral part which is positioned on the outer edge side, an inner peripheral blade, which extends from the side surface of the hub toward the outer edge side, is formed on a positive pressure surface of the blade surface part at the inner peripheral part of each of the blades, the inner peripheral blade includes a plurality of blade elements that project from the positive pressure surface of the blade surface part toward a positive pressure side, and are arranged side by side in a rotation direction of the blade, the blade elements include a first blade element, which is arranged on a front edge side in the rotation direction of the blade, and a second blade element, which is arranged to be adjacent to the first blade element on a rear edge side in the rotation direction of the blade, a first opening, which passes through the blade surface part from a negative pressure side toward the positive pressure side, is provided between the first blade element and the second blade element on the blade surface part, when an apex projecting from the positive pressure surface of the first blade element is A, a distance from the center axis to the apex A is r1, and a point having the distance r1 from the center axis on a front edge in a rotation direction of the first blade element is B, a chord length of the first blade element along a direction connecting the apex A with the point B, is equal to or larger than a chord length of the second blade element along a direction connecting an apex C with a point D when an apex projecting from the positive pressure surface of the second blade element is C, a distance from the center axis to the apex C is r2, and a point having the distance r2 from the center axis on a front edge in a rotation direction of the second blade element is D.

2. The propeller fan according to claim 1, wherein, when the first blade element and the second blade element are projected on a plane along the center axis of the hub, an area of a portion in which the first blade element is overlapped with the second blade element on the plane, is equal to or smaller than 75% of an area of the first blade element on the plane.

3. The propeller fan according to claim 1 or 2, wherein a position of the apex C of the second blade element is closer to a positive pressure side than a position of the apex A of the first blade element in a direction along the center axis of the hub is.

4. The propeller fan according to claim 1 wherein the second blade element is formed across the positive pressure surface and a negative pressure surface of the blade surface part via the first opening.

5. The propeller fan according to claim 1, wherein a second opening, which passes through the blade surface part from the negative pressure side toward the positive pressure side, is provided between a rear edge in the rotation direction of the blade and the second blade element on the blade surface part.

6. The propeller fan according to claim 1, wherein a reinforcing member is formed on the side surface of the hub, the reinforcing member coupling a rear edge in the rotation direction of the blade with the front edge of the next blade adjacent to the rear edge.

7. The propeller fan according to claim 1, wherein the blade elements project from a negative pressure surface of the blade surface part toward the negative pressure side.

* * * * *